US010104732B2

(12) United States Patent
Nakamura et al.

(10) Patent No.: US 10,104,732 B2
(45) Date of Patent: Oct. 16, 2018

(54) LED DRIVE METHOD AND LED DRIVE DEVICE

(71) Applicant: Renesas Electronics Corporation, Tokyo (JP)

(72) Inventors: Makoto Nakamura, Tokyo (JP); Motoaki Suzuki, Tokyo (JP); Mamoru Kitamura, Tokyo (JP); Keisuke Fukuda, Tokyo (JP)

(73) Assignee: RENESAS ELECTRONICS CORPORATION, Tokyo (JP)

( * ) Notice: Subject to any disclaimer, the term of this patent is extended or adjusted under 35 U.S.C. 154(b) by 0 days.

(21) Appl. No.: 15/354,681

(22) Filed: Nov. 17, 2016

(65) Prior Publication Data

US 2017/0071043 A1 Mar. 9, 2017

Related U.S. Application Data

(63) Continuation of application No. 14/922,141, filed on Oct. 24, 2015, now Pat. No. 9,510,417.

(30) Foreign Application Priority Data

Nov. 17, 2014 (JP) ..... 2014-232574

(51) Int. Cl.
*H05B 33/08* (2006.01)

(52) U.S. Cl.
CPC ..... *H05B 33/0845* (2013.01); *H05B 33/0815* (2013.01); *H05B 33/0818* (2013.01); *H05B 33/0851* (2013.01); *H05B 33/0884* (2013.01)

(58) Field of Classification Search
None
See application file for complete search history.

(56) References Cited

U.S. PATENT DOCUMENTS

| | | | | |
|---|---|---|---|---|
| 7,855,520 | B2 | 12/2010 | Leng | |
| 8,339,053 | B2 | 12/2012 | Yamasaki | |
| 8,729,827 | B2 * | 5/2014 | Esaki | H05B 37/02 315/257 |
| 9,030,113 | B2 | 5/2015 | Esaki et al. | |
| 2014/0354170 | A1 * | 12/2014 | Gredler | H05B 33/0815 315/224 |

FOREIGN PATENT DOCUMENTS

| | | | |
|---|---|---|---|
| JP | 2005-189902 | A | 7/2005 |
| JP | 2009-123681 | A | 6/2009 |
| JP | 2013-093116 | A | 5/2013 |
| JP | 2014-013866 | A | 1/2014 |

OTHER PUBLICATIONS

Japanese Office Action dated Feb. 20, 2018, with an English translation thereof.

* cited by examiner

*Primary Examiner* — Minh D A
*Assistant Examiner* — James H Cho
(74) *Attorney, Agent, or Firm* — McGinn IP Law Group, PLLC

(57) ABSTRACT

An LED drive method drives an LED by a drive current. The LED drive method uses a voltage conversion unit, which includes a coil and a first switch, and converts an external voltage into a first voltage, which is a DC voltage, by controlling the first switch to be on in an on-pulse period of a first drive signal. A constant current drive unit is provided with the first voltage and generates a drive current based on a second drive signal.

12 Claims, 17 Drawing Sheets

LED DRIVE METHOD AND LED DRIVE DEVICE

This Application is a Continuation Application of U.S. patent application Ser. No. 14/922,141, filed on Oct. 24, 2015, now U.S. Pat. No. 9,510,417.

CROSS-REFERENCE TO RELATED APPLICATIONS

The disclosure of Japanese Patent Application No. 2014-232574 filed on Nov. 17, 2014 including the specification, drawings and abstract is incorporated herein by reference in its entirety.

BACKGROUND

The present invention relates to an LED drive method and an LED drive device, for example, relates to an LED drive method and an LED drive device which drive an LED by using an AC voltage as an input.

RELATED ART

Japanese Unexamined Patent Application Publication No. 2014-13866 discloses an illumination device including a bleeder circuit on a secondary side of a transformer. Japanese Unexamined Patent Application Publication No. 2005-189902 discloses a control device including an H mode controller, an L mode controller, a mode switching device that switches outputs of the two controllers, and a bumpless auxiliary switching device that returns an output of the mode switching device to each of the two controllers.

SUMMARY

For example, in an LED (Light Emitting Diode), flicking (in other words, flicker) may occur when the LED is in a low brightness state. As shown in Japanese Unexamined Patent Application Publication No. 2014-13866, it is considered to provide a bleeder circuit to reduce the flicker. However, when providing the bleeder circuit, a bleeder resistance and a switch that switches between coupling and uncoupling of the bleeder resistance are required, so that there is a risk that the downsizing and the cost reduction of the LED drive device are not achieved. When the bleeder resistance is coupled, useless power is consumed by the bleeder resistance, so that there is a risk that the power consumption of the LED drive device cannot be reduced (in other words, there is a risk that the power conversion efficiency cannot be improved).

Embodiments described later are made in view of the above, and other problems and new features will become clear from the description of the present specification and the accompanying drawings.

An LED drive method according to an embodiment drives an LED by using a voltage conversion unit, a constant current drive unit, and a control unit. A voltage conversion unit includes a coil and a first switch and converts an AC voltage into a first voltage which is a DC voltage by controlling the first switch to be on in an on-pulse period of a first drive signal. The constant current drive unit is supplied with the first voltage and generates a drive current Id having a current value according to light control information. The control unit compares brightness based on the light control information and reference brightness, generates the first drive signal based on an error between the first voltage and a target voltage representing a target of the first voltage when the brightness is higher than the reference brightness, and generates the first drive signal having a predetermined fixed on-pulse period when the brightness is lower than the reference brightness.

According to an embodiment, for example, it is possible to reduce the flicker when the LED is in a low brightness state.

BRIEF DESCRIPTION OF THE DRAWINGS

FIG. 17A is a waveform chart of a steady operation during high brightness light control. FIG. 17B is a waveform chart of an intermittent operation during low brightness light control.

DETAILED DESCRIPTION

The following embodiments will be explained, divided into plural sections or embodiments, if necessary for convenience. Except for the case where it shows clearly in particular, they are not mutually unrelated and one has relationships such as a modification, details, and supplementary explanation of some or entire of another. In the following embodiments, when referring to the number of elements, etc. (including the number, a numeric value, an amount, a range, etc.), they may be not restricted to the specific number but may be greater or smaller than the specific number, except for the case where they are clearly specified in particular and where they are clearly restricted to a specific number theoretically.

Furthermore, in the following embodiments, it is needless to say that an element (including an element step etc.) is not necessarily indispensable, except for the case where it is clearly specified in particular and where it is considered to be clearly indispensable from a theoretical point of view, etc. Similarly, in the following embodiments, when shape, position relationship, etc. of an element etc. is referred to, what resembles or is similar to the shape substantially shall be included, except for the case where it is clearly specified in particular and where it is considered to be clearly not right from a theoretical point of view. This statement also applies to the numeric value and range described above.

Further, in the embodiments, a MOSFET (Metal Oxide Semiconductor Field Effect Transistor) (abbreviated as MOS transistor) is used as an example of a MISFET (Metal Insulator Semiconductor Field Effect Transistor). However, non-oxide film is not excluded as a gate insulating film.

Hereinafter, the embodiments of the present invention will be described in detail with reference to the drawings. In all the drawings for explaining the embodiments, the same symbol is attached to the same member, as a principle, and the repeated explanation thereof is omitted.

First Embodiment

Schematic Configuration of LED Drive System

Figure 1:
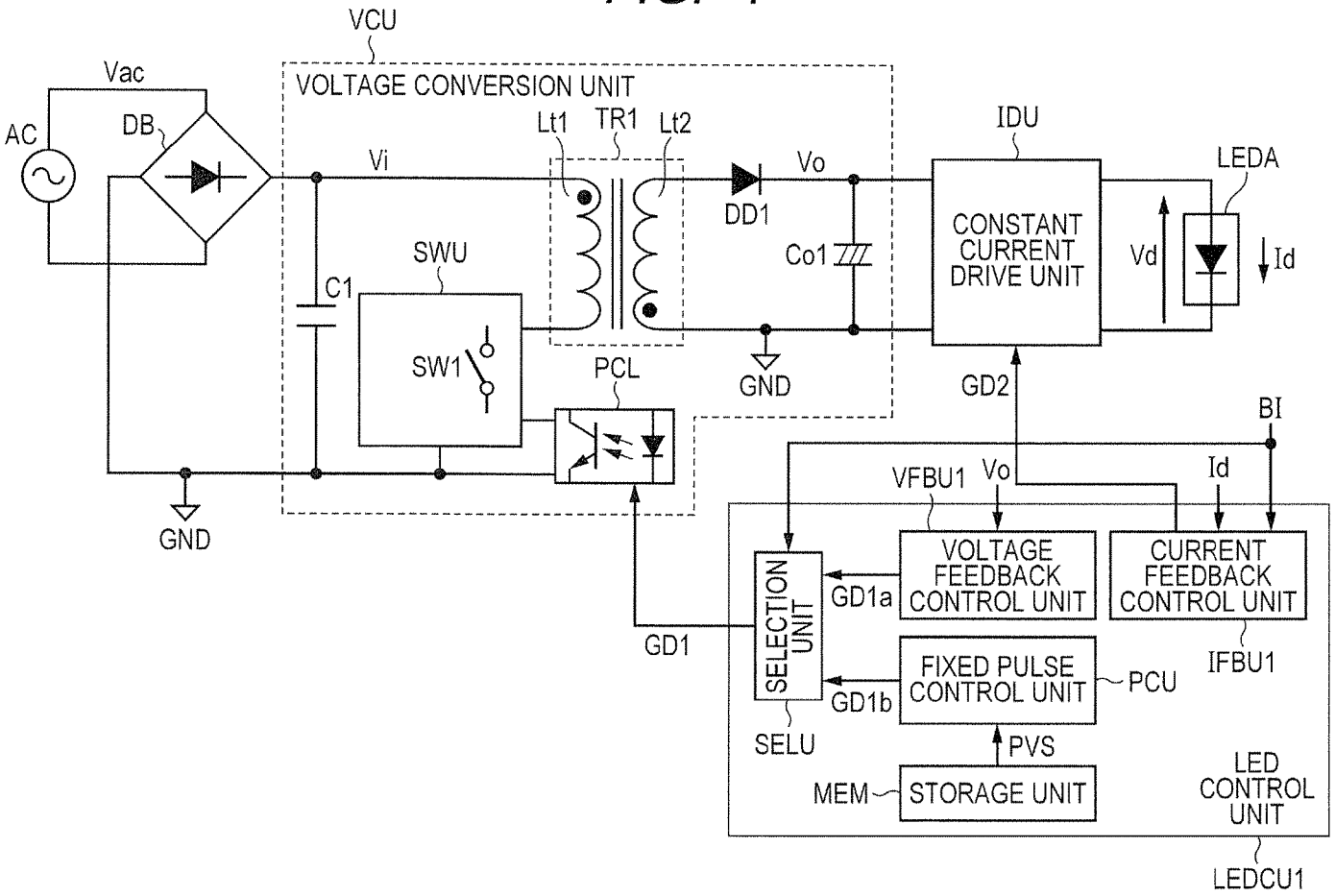
FIG. 1 is a circuit block diagram showing a schematic configuration example of an LED drive system according to a first embodiment of the present invention.

FIG. 1 is a circuit block diagram showing a schematic configuration example of an LED drive system according to a first embodiment of the present invention. The LED drive system shown in FIG. 1 includes a rectifier DB, a voltage conversion unit VCU, a constant current drive unit IDU, an LED control unit LEDCU1, and an LED array LEDA. The rectifier DB rectifies an AC voltage Vac inputted from an external commercial power supply AC and outputs an input voltage Vi by using a ground voltage GND as a reference. It is possible to configure so that the input voltage Vi is directly obtained from a DC power supply such as a battery without using the external commercial power supply AC and the rectifier DB.

The voltage conversion unit VCU generally includes a coil (here, a transformer TR1) and a first switch SW1, and converts an input voltage Vi outputted from the rectifier DB into an output voltage (a first voltage) Vo by controlling on/off of the first switch SW1 by a first drive signal GD1. In this case, the voltage conversion unit VCU controls the first switch SW1 to be on during an on-pulse period of the first drive signal GD1. In FIG. 1, an AC/DC converter of a so-called flyback system is shown as an example of the voltage conversion unit VCU that performs such an operation as described above.

More specifically, the voltage conversion unit VCU includes a capacitor C1, a transformer TR1, a switching control unit SWU, a photocoupler PCL, a diode DD1, and a smoothing capacitor Co1. The capacitor C1 is coupled between the input voltage Vi and the ground voltage GND and performs removal of noise included in the input voltage Vi and the like. The transformer TR1 includes a primary coil Lt1 and a secondary coil Lt2.

One end of the primary coil Lt1 is coupled to the input voltage Vi and the other end is coupled to the ground voltage GND through the first switch SW1 in the switching control unit SWU. Here, on/off of the first switch SW1 is controlled by the first drive signal GD1 through the photocoupler PCL. One end of the secondary coil Lt2 is coupled to the anode of the diode DD1 and the other end is coupled to the ground voltage GND. The smoothing capacitor Co1 is provided between the cathode of the diode DD1 and the ground voltage GND. The output voltage (the first voltage) Vo is generated at a coupling node between the smoothing capacitor Co1 and the diode DD1.

Generally, the constant current drive unit IDU is supplied with the output voltage Vo, generates a drive current Id having a current value according to light control information BI inputted from outside, and drives the LED array LEDA with the drive current Id. Although described in detail in FIG. 5, the constant current drive unit IDU includes a coil and a second switch, and generates the drive current Id by controlling on/off of the second switch by a second drive signal GD2 that is a PWM signal.

The LED control unit LEDCU1 includes a voltage feedback control unit VFBU1, a fixed pulse control unit PCU, a selection unit SELU, a storage unit MEM, and a current feedback control unit IFBU1. The voltage feedback control unit VFBU1 generates a first drive signal GD1*a* based on an error between the output voltage (the first voltage) Vo and a target voltage representing a target of the output voltage Vo. Specifically, the voltage feedback control unit VFBU1 generates, for example, the first drive signal GD1*a* having an on-pulse period based on the error. The fixed pulse control unit PCU generates a first drive signal GD1*b* having a predetermined fixed on-pulse period or additionally a predetermined fixed cycle. The fixed on-pulse period and cycle are held in the storage unit MEM as a voltage pulse setting value PVS in advance.

The selection unit SELU selects either one of the first drive signal GD1*a* from the voltage feedback control unit VFBU1 and the first drive signal GD1*b* from the fixed pulse control unit PCU and outputs the selected first drive signal GD1 to the first switch SW1 of the voltage conversion unit VCU. Specifically, the selection unit SELU determines whether brightness based on the light control information BI is higher than or lower than predetermined reference brightness. The selection unit SELU selects the first drive signal GD1*a* in a first case in which the brightness is higher than the reference brightness and selects the first drive signal GD1*b* in a second case in which the brightness is lower than the reference brightness. In some cases, the selection unit SELU can perform the selection operation by determining the magnitude of the drive current Id instead of the brightness based on the light control information BI.

The current feedback control unit IFBU1 generates the second drive signal GD2 based on an error between the drive current Id and a target current representing a target of the drive current Id. In this case, the target current is variably set according to the light control information BI. Although the light control information BI is not particularly limited, the light control information BI is generated by a remote control or the like that adjusts the brightness of the LED.

Operation of Main Part of LED Control Unit

Figure 2:
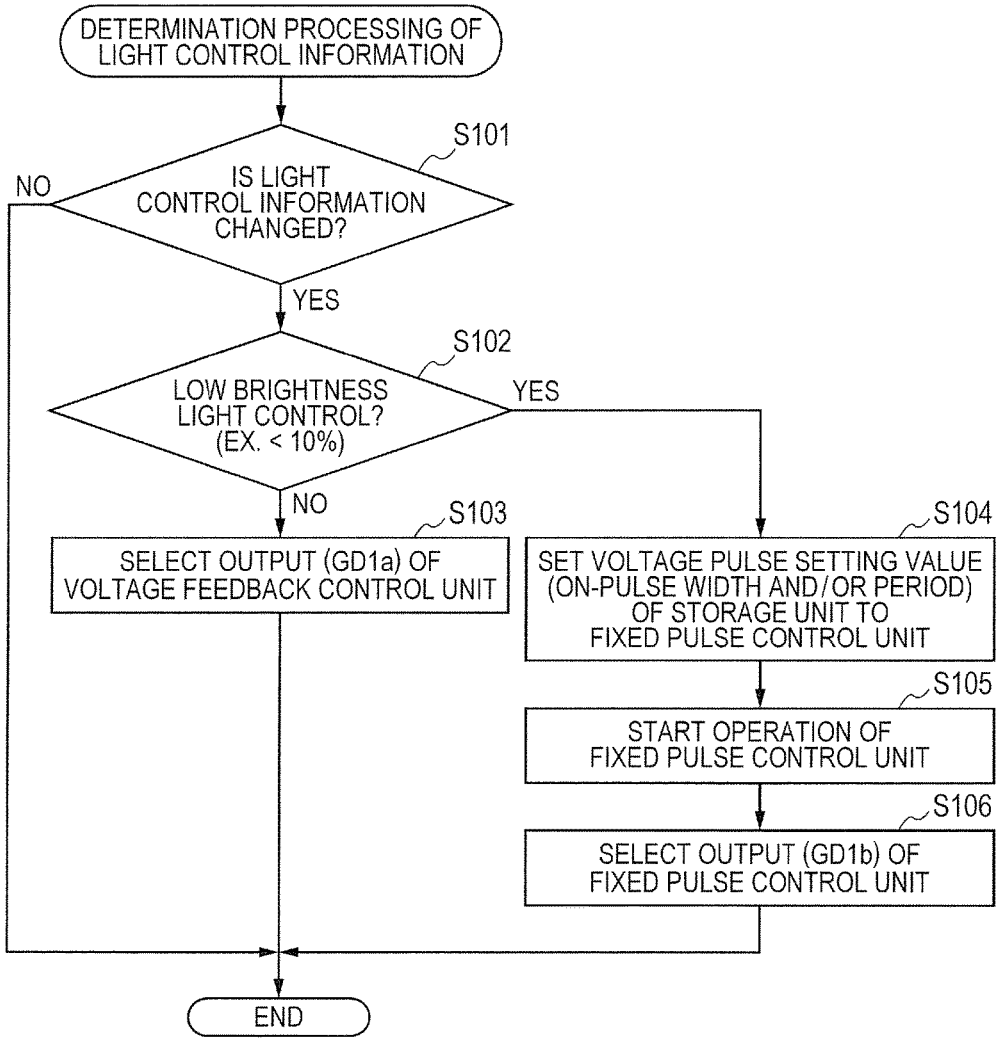
FIG. 2 is a flowchart showing an operation example of a main part of an LED control unit in the LED drive system in FIG. 1.

FIG. 2 is a flowchart showing an operation example of a main part of the LED control unit in the LED drive system in FIG. 1. As shown in FIG. 2, the LED control unit LEDCU1 performs determination processing of the light control information BI based on the light control information BI inputted from outside. In FIG. 2, the LED control unit LEDCU1 first determines whether or not there is a change in brightness represented by the light control information BI (step S101).

In step S101, when there is no change in the brightness, the LED control unit LEDCU1 ends the processing. On the other hand, when there is a change in the brightness, the LED control unit LEDCU1 (for example, the selection unit SELU) determines whether or not the brightness is lower than predetermined reference brightness (in this example, 10%) (in other words, whether or not the brightness represents low brightness light control) (step S102). When the brightness does not represent the low brightness light control, the LED control unit LEDCU1 (for example, the selection unit SELU) selects the first drive signal GD1*a* from the voltage feedback control unit VFBU1 (step S103).

On the other hand, when the brightness represents the low brightness light control in step S102, the LED control unit LEDCU1 sets the voltage pulse setting value PVS (that is, a fixed on-pulse period or additionally a predetermined fixed cycle) stored in the storage unit MEM to the fixed pulse control unit PCU (step S104). Thereafter, the LED control unit LEDCU1 starts operation of the fixed pulse control unit PCU (step S105). Further, along with step S105, the LED control unit LEDCU1 (for example, the selection unit SELU) selects the first drive signal GD1*b* from the fixed pulse control unit PCU (step S106).

By the operations described above, the first drive signal GD1 that controls the first switch SW1 is generated by the fixed pulse control unit PCU in the case of low brightness light control (in a second case) and is generated by the voltage feedback control unit VFBU1 in the case of no low brightness light control (in a first case). The fixed pulse control unit PCU can stop the operation in the case of no low brightness light control.

Main Effects and the Like of LED Drive System

Figure 16:
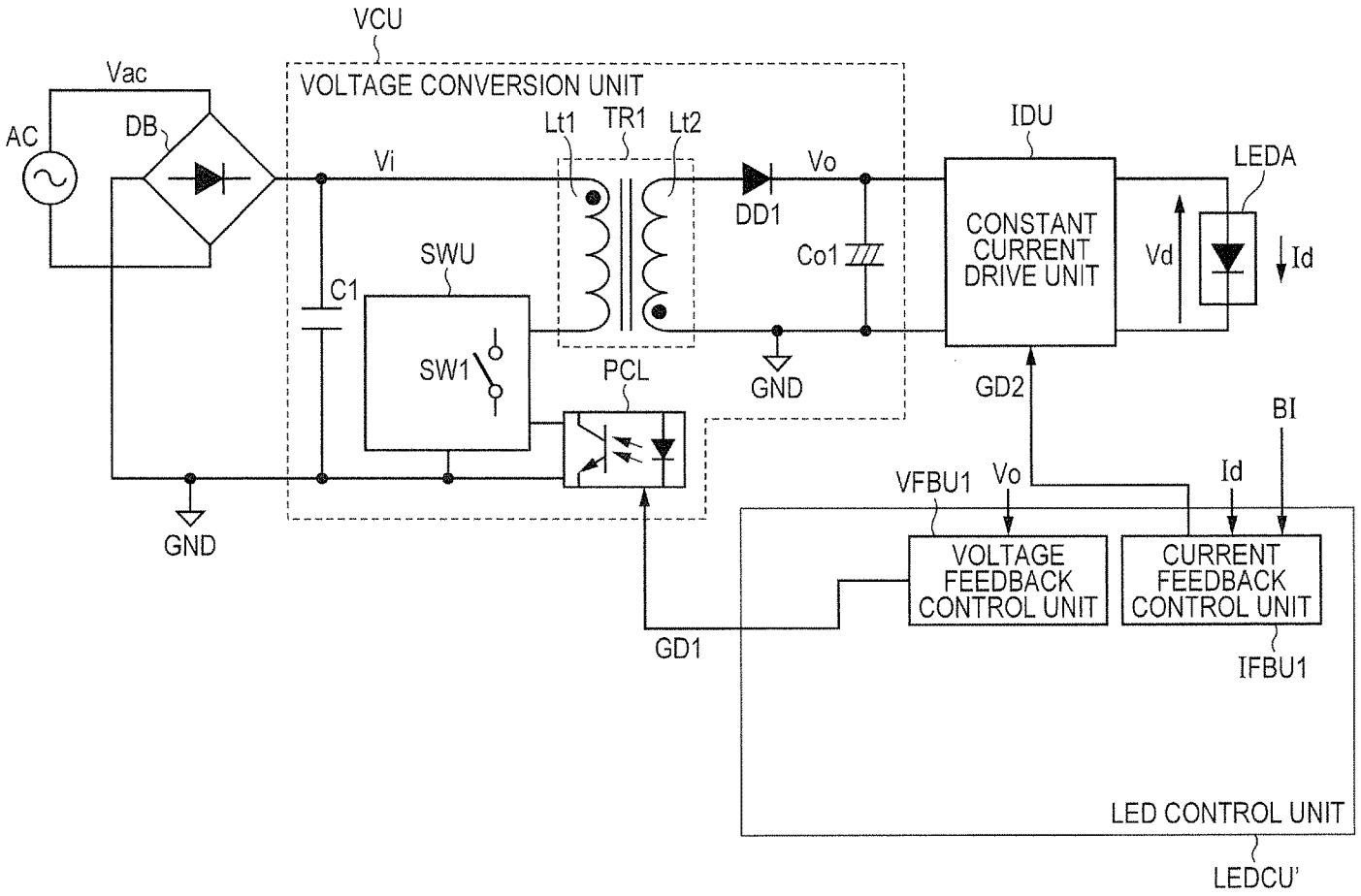
FIG. 16 is a circuit block diagram showing a schematic configuration example of an LED drive system studied as a comparative example of the present invention.

FIG. 16 is a circuit block diagram showing a schematic configuration example of an LED drive system studied as a comparative example of the present invention. The LED drive system shown in FIG. 16 is different from the LED drive system shown in FIG. 1 in a point that the fixed pulse control unit PCU, the storage unit MEM, and the selection unit SELU are not included in an LED control unit LEDCU'.

Figure 17A:
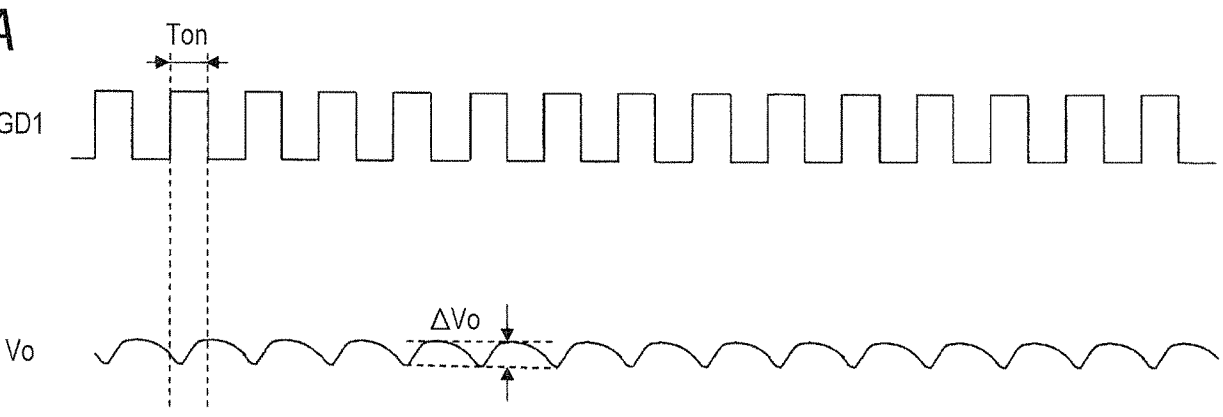
FIGS. 17A and 17B are waveform charts showing a schematic operation example of the LED drive system in FIG. 16.
Figure 17B:
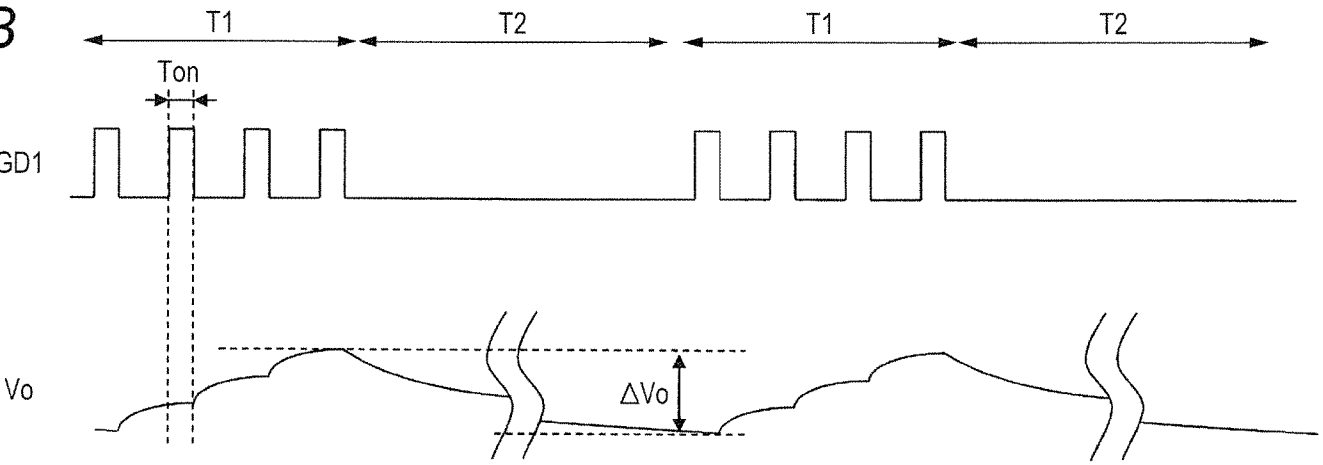

FIGS. 17A and 17B are waveform charts showing a schematic operation example of the LED drive system in FIG. 16. FIG. 17A is a waveform chart of a steady operation during high brightness light control. FIG. 17B is a waveform chart of an intermittent operation during the low brightness light control. In the configuration of FIG. 16 that does not include the fixed pulse control unit PCU, the first switch SW1 of the voltage conversion unit VCU is controlled by the first drive signal GD1 and accordingly the output voltage Vo is generated.

In this case, the voltage feedback control unit VFBU1 determines an on-pulse period Ton of the first drive signal GD1 by, for example, proportional-integral control (so-called PI control) using a certain fixed control parameter (a phase compensation parameter). During the low brightness light control, it is possible to sufficiently maintain the output voltage Vo by a short on-pulse period Ton, so that the on-pulse period Ton is determined to be a small value.

On the other hand, the voltage feedback control unit VFBU1 determines the on-pulse period Ton for controlling the output voltage Vo to be constant in a range of the drive current Id according to a brightness of 0% to 100% by a fixed control parameter (a phase compensation parameter), so that it may not be possible to follow variation of phase characteristics when the brightness is changed and an operation area of the drive current Id is changed. For example, when using a control parameter that is set so that optimal control is performed during high brightness light control, the responsivity of feedback may not be sufficient during the low brightness light control. Specifically, a sufficient control band (in other words, a high zero crossing frequency) may not be secured.

Thereby, even when the voltage feedback control unit VFBU1 determines the on-pulse period Ton to be a small value, there is a risk that the voltage feedback control unit VFBU1 determines the on-pulse period Ton to be longer than a required length. Further, there is a risk that the voltage feedback control unit VFBU1 generates the first drive signal GD1 having such an on-pulse period Ton continuously until, for example, an overvoltage of the output voltage Vo is detected. As a result, different from a steady operation where pulses are continuously generated as shown in FIG. 17A, the voltage feedback control unit VFBU1 may perform an operation where a period T1 in which pulses are outputted and a period T2 in which no pulse is outputted are repeated as shown in FIG. 17B. In the present application, this is called an intermittent operation.

In the period T1, the next on-pulse period Ton appears before power supplied during one on-pulse period Ton is consumed in the LED array LEDA, so that the output voltage Vo rises significantly. When the voltage feedback control unit VFBU1 detects an overvoltage of the output voltage Vo or the like, in the period T2, the voltage feedback control unit VFBU1 stops outputting pulses until the overvoltage state is eliminated (in other words, until the output voltage Vo lowers to a predetermined value). By such an intermittent operation, the output voltage Vo fluctuates in a large fluctuation width ΔVo.

On the other hand, the constant current drive unit IDU normally generates the drive current Id at a PWM on-duty close to a minimum value during the low brightness light control. Therefore, when the output voltage Vo rises significantly in the period T1, the constant current drive unit IDU cannot further decrease the PWM on-duty accordingly, so that the constant current drive unit IDU causes the drive current Id to increase. As a result, the brightness of the LED array LEDA increases. On the contrary, in the period T2, the constant current drive unit IDU decreases the drive current Id according to the decrease of the output voltage Vo. As a result, the brightness of the LED array LEDA decreases. In this manner, the fluctuation width ΔVo of the output voltage Vo is increased by the intermittent operation and the drive current Id is not controlled at a constant level, so that flicking (flicker) of the LED array LEDA may occur during the low brightness light control.

Figure 3:
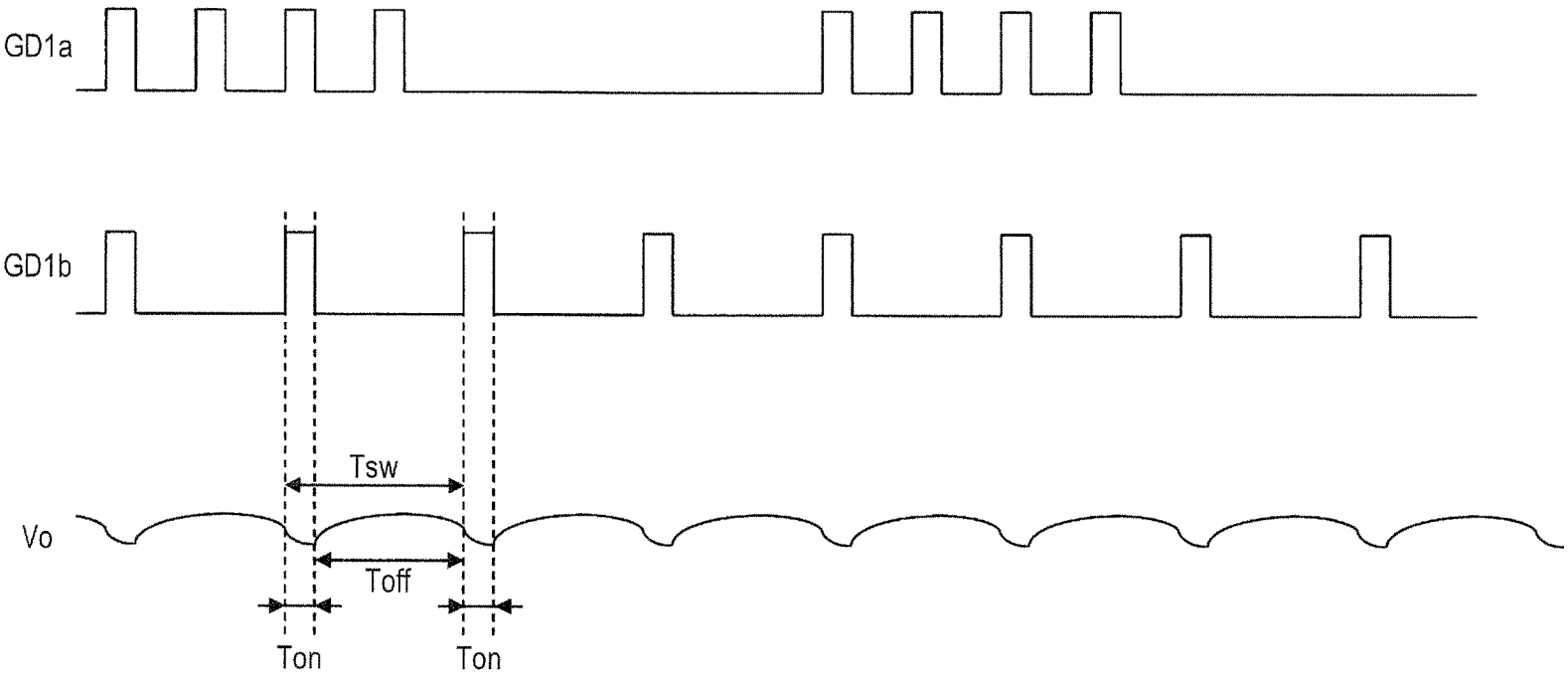
FIG. 3 is a waveform chart showing a schematic operation example during low brightness light control in the LED drive system in FIG. 1.

FIG. 3 is a waveform chart showing a schematic operation example during the low brightness light control in the LED drive system in FIG. 1. In the example in FIG. 3, different from the case of FIG. 17B, the first switch SW1 of the voltage conversion unit VCU is controlled by the first drive signal GD1*b* from the fixed pulse control unit PCU, and the output voltage Vo is generated based on the first drive signal GD1*b*. In the example of FIG. 3, the on-pulse width Ton of the first drive signal GD1*b* is the same as the on-pulse width of the first drive signal GD1*a* during the low brightness light control. However, a cycle Tsw of the first drive signal GD1*b* is fixedly set in advance so that the cycle Tsw is longer than the cycle of the first drive signal GD1*a* during the low brightness light control.

In this case, the transformer TR1 accumulates power during the on-pulse period Ton of the first drive signal GD1*b*. Then, the transformer TR1 discharges the accumulated power from the secondary side of the transformer TR1 through the diode DD1 during an off-pulse period Toff. The LED array LEDA is driven by the discharged power and the smoothing capacitor Co1 is charged by the discharged power. Here, the off-pulse period Toff of the first drive signal GD1*b* is longer than the off-pulse period of the first drive signal GD1*a*. Therefore, during the off-pulse period Toff, the power discharged from the transformer TR1 is sufficiently consumed, and the output voltage Vo rises once and then falls to some extent.

While the transformer TR1 is being charged with power during the next on-pulse period Ton, the LED array DEDA is driven by the smoothing capacitor Co1 and the output voltage Vo falls to a predetermined target voltage. Thereafter, the same operation is repeated in the off-pulse period Toff. As a result, the variation of the output voltage Vo is sufficiently smaller than that in the case of FIG. 17B.

Figure 4:
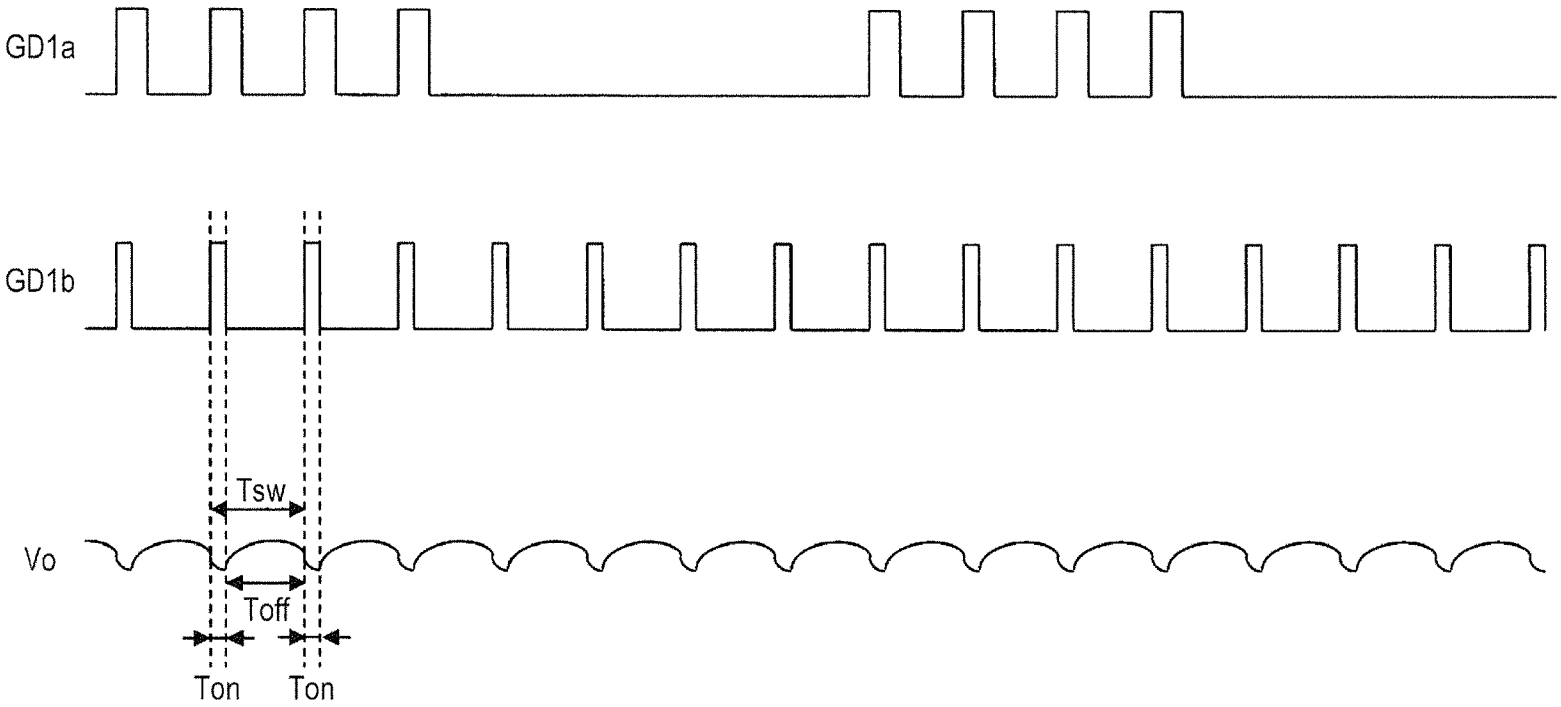
FIG. 4 is a waveform chart showing a schematic operation example different from FIG. 3 which is under low brightness light control in the LED drive system in FIG. 1.

FIG. 4 is a waveform chart showing a schematic operation example different from FIG. 3 which is under the low brightness light control in the LED drive system in FIG. 1. In the example in FIG. 4, in the same manner as in FIG. 3, the first switch SW1 of the voltage conversion unit VCU is controlled by the first drive signal GD1*b* from the fixed pulse control unit PCU, and the output voltage Vo is generated based on the first drive signal GD1*b*. In the example of FIG. 4, different from the case of FIG. 3, the cycle Tsw of the first drive signal GD1*b* is the same as the cycle of the first drive signal GD1*a* during the low brightness light control. However, the on-pulse period Ton of the first drive signal GD1*b* is fixedly set in advance so that the on-pulse period Ton is shorter than the on-pulse period of the first drive signal GD1*a* during the low brightness light control.

In this case, the power accumulated in the transformer TR1 in the on-pulse period Ton of the first drive signal GD1*b* is smaller than the power accumulated in the on-pulse period of the first drive signal GD1*a*. Therefore, different from the case of FIG. 17B, even if the period Tsw of the first drive signal GD1*b* is the same as that of the first drive signal GD1*a*, the next on-pulse period To appears after the power supplied during one on-pulse period Ton is sufficiently consumed by the LED array LEDA. As a result, the variation of the output voltage Vo is sufficiently smaller than that in the case of FIG. 17B.

As described above, it is possible to sufficiently reduce the variation of the output voltage Vo during the low brightness light control, so that it is possible to reduce flicking (flicker) of the LED array LEDA. In this case, it is not necessary to provide a bleeder circuit as shown in Japanese Unexamined Patent Application Publication No. 2014-13866, so that it is possible to reduce the size and cost of the LED drive system. Further, it is not necessary to provide a bleeder circuit, so that it is possible to realize reduction of power consumption (in other words, improvement of power conversion efficiency in the voltage conversion unit VCU) of the LED drive system.

In the examples in FIGS. 1 and 2, the number of the voltage pulse setting values PVS is one. However, it is possible to set a plurality of pulse setting values PVS. Specifically, for example, it is possible to prepare a plurality of reference brightness values (for example, 10%, 5%, and the like) used for the determination in step S102 in FIG. 2 and to set different voltage pulse setting values PVS into the fixed pulse control unit PCU, respectively, between 10% and 5% and between 5% and 0% of the brightness represented by the light control information BI.

Further, in the examples in FIGS. 1 and 2, the voltage pulse setting value PVS, which is a fixed value, is held in the storage unit MEM. However, a predetermined arithmetic expression can be held instead of the voltage pulse setting value PVS. Specifically, for example, the brightness represented by the light control information BI is defined as a variable and an arithmetic expression may be held which calculates an on-pulse width according to the variable or additionally a cycle according to the variable.

The fixed pulse control unit PCU defines the on-pulse period Ton of the first drive signal GD1*b* to be a fixed value. On the other hand, the fixed pulse control unit PCU defines the cycle Tsw of the first drive signal GD1*b* to be a fixed value, and further when the switching system of the voltage feedback control unit VFBU1 is an asynchronous system, the fixed pulse control unit PCU can use a switching cycle of the voltage feedback control unit VFBU1 as the cycle Tsw of the first drive signal GD1*b*. In other words, while the fixed pulse control unit PCU generates the first drive signal GD1*b* at the switching cycle of the voltage feedback control unit VFBU1, the fixed pulse control unit PCU can also define the on-pulse period Ton for each switching cycle to be a fixed value.

However, in practice, the on-pulse period Ton of the first drive signal GD1*b* may be able to be shortened only to a certain extent due to restriction of hardware or the like, so that the variation of the output voltage Vo may not be able to be sufficiently reduced by only defining the on-pulse period Ton. Therefore, from this viewpoint, it is desirable to define both of the on-pulse period Ton and the cycle Tsw of the first drive signal GD1*b* to be fixed values. The on-pulse period Ton and the cycle Tsw can be defined to be appropriate values by, for example, performing simulation or the like in advance.

In FIG. 2, the operation of the fixed pulse control unit PCU is stopped in the case of no low brightness light control. Thereby, it is possible to suppress increase of unnecessary power consumption. On the other hand, it is desirable that the voltage feedback control unit VFBU1 operates continuously regardless of whether or not the low brightness light control is employed. Specifically, different from the fixed pulse control unit PCU, the voltage feedback control unit VFBU1 performs integral control with feedback, so that if the voltage feedback control unit VFBU1 once stops operation, there is a risk that it takes some time for the voltage feedback control unit VFBU1 to reach a stable state after restarting the operation. Therefore, the voltage feedback control unit VFBU1 is caused to operate continuously, so that it is possible to secure responsiveness to change of the light control information BI.

Configuration and Operation of LED Drive Device

Figure 5:
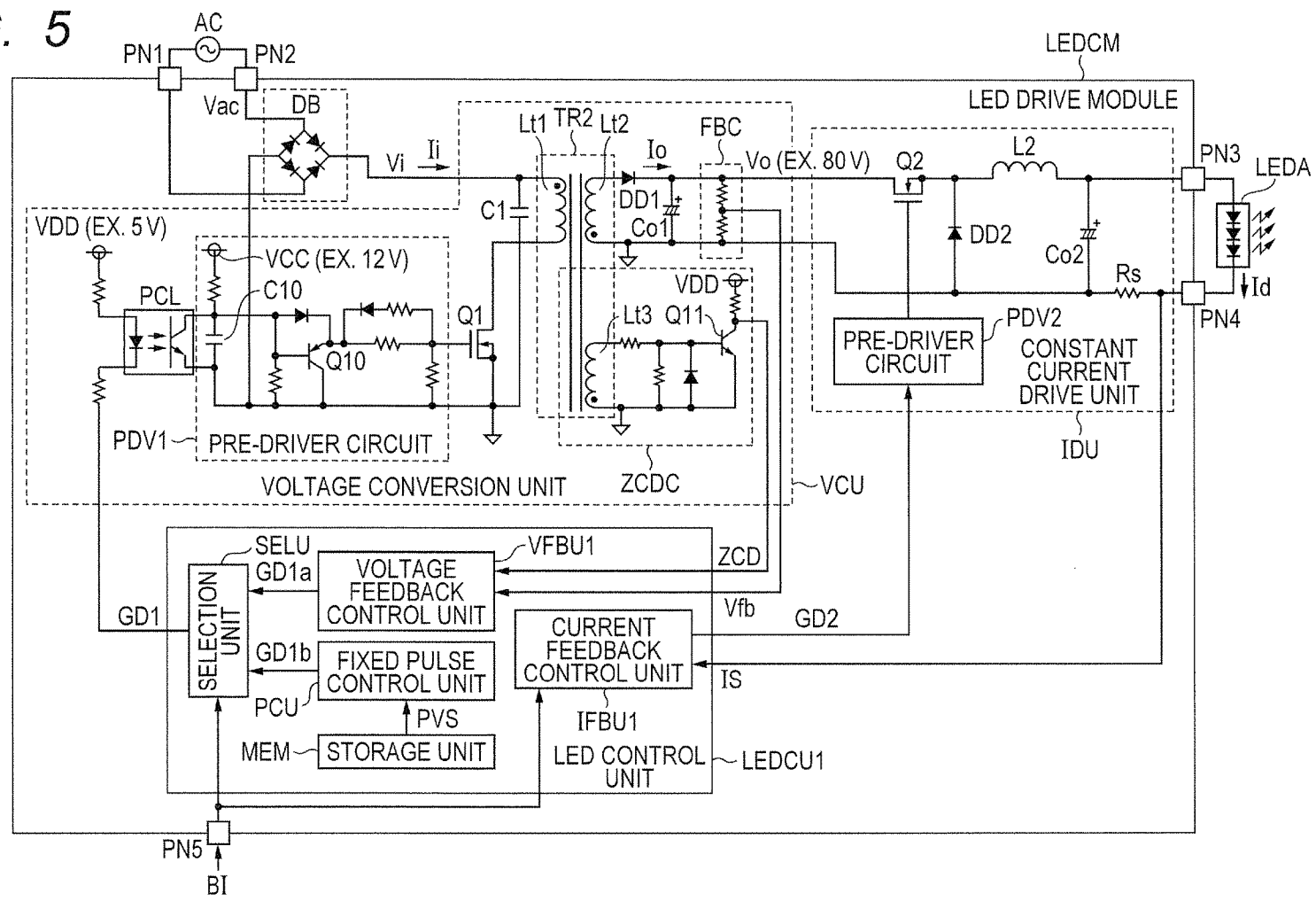
FIG. 5 is a circuit diagram showing a configuration example of an LED drive device of the first embodiment of the present invention.

FIG. 5 is a circuit diagram showing a configuration example of an LED drive device of the first embodiment of the present invention. In FIG. 5, a detailed configuration example of the LED drive system shown in FIG. 1 is shown, and a portion where the LED array LEDA and the commercial power supply AC are removed from FIG. 1 is provided in an LED drive module (the LED drive device) LEDCM. The LED drive module (the LED drive device) LEDCM in FIG. 5 includes, for example, a wiring substrate and components mounted on the wiring substrate and includes a plurality of external terminals PN1 to PN5.

The commercial power supply AC is coupled between the external terminal PN1 and the external terminal PN2. The LED array LEDA is coupled between the external terminal PN3 and the external terminal PN4. The light control information BI is inputted into the external terminal PN5. Hereinafter, explanation related to portions overlapping with FIG. 1 is omitted and differences from FIG. 1 will be mainly focused on and described.

A rectifier DB full-wave rectifies the AC voltage Vac from the commercial power supply AC by using four diodes. The voltage conversion unit VCU includes a photocoupler PCL, a pre-driver circuit PDV1, a transistor Q1, a transformer TR2, a capacitor C1, a diode DD1, a smoothing capacitor Co1, a feedback resistance circuit FBC, and a zero current detection circuit ZCDC. The transistor Q1 corresponds to the first switch SW1 in FIG. 1 and includes, for example, an n-type LDMOS (Laterally Diffused Metal Oxide Semiconductor) transistor or the like.

The pre-driver circuit PDV1 is provided with a power supply voltage VCC of, for example, 12 V or the like and controls on/off of the transistor Q1 by using the power supply voltage VCC according to the first drive signal GD1 inputted through the photocoupler PCL. A photodiode included in the photocoupler PCL is provided with a power supply voltage VDD of, for example, 5V. For example, the first drive signal GD1 outputs a level of the power supply voltage VDD during the on-pulse period Ton and outputs a level of the ground voltage GND during the off-pulse period Toff.

During the on-pulse period Ton of the first drive signal GD1, no current flows in the photodiode included in the photocoupler PCL and a transistor included in the photocoupler PCL is turned off. As a result, the pre-driver circuit PDV1 charges a gate capacitance of the transistor Q1 and an inner capacitor C10 by using the power supply voltage VCC through inner diodes and resistances appropriately. On the other hand, during the off-pulse period of the first drive signal GD1, the transistor included in the photocoupler PCL is turned on. As a result, the pre-driver circuit PDV1 discharges the inner capacitor C10, drives the inner transistor Q10 to be turned on, and discharges the gate capacitance of the transistor Q1 to the ground voltage GND.

The transformer TR2 includes an auxiliary coil Lt3 to detect zero current in addition to the primary coil Lt1 and the secondary coil Lt2 shown in FIG. 1. The auxiliary coil Lt3 forms a part of the zero current detection circuit ZCDC. The zero current detection circuit ZCDC outputs a zero current detection signal ZCD that changes between the power supply voltage VDD and the ground voltage GND by controlling on/off of a transistor Q11 according to the voltages at both ends of the auxiliary coil Lt3.

Specifically, in the case of flyback system, the power accumulated in the transformer TR2 is discharged from the secondary side of the transformer TR2 during the off-pulse period Toff of the transistor Q1. While the power is discharged, the transistor Q11 is controlled to be on by using the auxiliary coil Lt3 as an electromotive force. As a result, the zero current detection signal ZCD becomes a level of the ground voltage GND. On the other hand, when the power of the transformer TR2 is exhausted (in other words, a zero current state is reached), the electromotive force of the auxiliary coil Lt3 disappears and the transistor Q11 is controlled to be off. As a result, the zero current detection signal ZCD changes to the level of the power supply voltage VDD.

The feedback resistance circuit FBC resistance-divides an output voltage (a first voltage) Vo controlled to be 80 V or the like and generates a feedback voltage Vfb proportional to the output voltage Vo. For example, the resistance ratio of the feedback resistance circuit FBC is adjusted so that the feedback voltage Vfb is within a range between the power supply voltage VDD and the ground voltage GND.

The constant current drive unit IDU includes a transistor (a second switch) Q2, a diode DD2, a coil L2, a smoothing capacitor Co2, a current detection resistance Rs, and a pre-driver circuit PDV2. The transistor (a second switch) Q2 is composed of, for example, an n-type LDMOS transistor or the like. The transistor (the second switch) Q2 is provided between a node of the output voltage Vo and one end of the coil L2, and on/off of the transistor Q2 is controlled through the pre-driver circuit PDV2 coupled to the gate.

The cathode of the diode DD2 is coupled to one end of the coil L2 and the anode of the diode DD2 is coupled to the ground voltage GND. The other end of the coil L2 is coupled to the external terminal PN3. One end of the smoothing capacitor Co2 is coupled to the external terminal PN3 and the other end is coupled to the external terminal PN4 through the current detection resistance Rs. The pre-driver circuit PDV2 controls on/off of the transistor Q2 according to the second drive signal GD2.

When the transistor Q2 is controlled to be on, the diode DD2 is biased in the opposite direction and the current flowing through the coil L2 rises at a predetermined inclination (an inclination according to a difference between the output voltage Vo and the voltage of the external terminal PN3). On the other hand, when the transistor Q2 is controlled to be off, the diode DD2 is biased in the forward direction and the current flowing through the coil L2 decreases at a predetermined inclination (an inclination according to a difference between the voltage of the external terminal PN3 and the ground voltage GND). The drive current Id is controlled to be a target current by controlling the current flowing through the coil L2 by on/off of the transistor Q2. A voltage according to the number of serially coupled LEDs is applied between the external terminals PN3 and PN4, and a voltage (for example, 30 V) lower than the output voltage Vo is applied.

In the same manner as in FIG. 1, the LED control unit LEDCU1 includes the voltage feedback control unit VFBU1, the fixed pulse control unit PCU, the selection unit SELU, the storage unit MEM, and the current feedback control unit IFBU1. For example, the LED control unit LEDCU1 is composed of one semiconductor chip (a semiconductor device) and is composed of a micro control unit or the like. The light control information BI is inputted into the selection unit SELU and the current feedback control unit IFBU1 through the external terminal PN5.

Instead of the output voltage Vo shown in FIG. 1, the feedback voltage Vfb proportional to the output voltage Vo is inputted into the voltage feedback control unit VFBU1. Further, the zero current detection signal ZCD is inputted into the voltage feedback control unit VFBU1. Instead of the drive current Id shown in FIG. 1, a current detection voltage IS at the external terminal PN4 is inputted into the current feedback control unit IFBU1. In other words, the drive current Id of the LED array LEDA is converted into the current detection voltage IS proportional to the drive current Id through the current detection resistance Rs.

Details of Voltage Feedback Control Unit and Current Feedback Control Unit

Figure 6A:
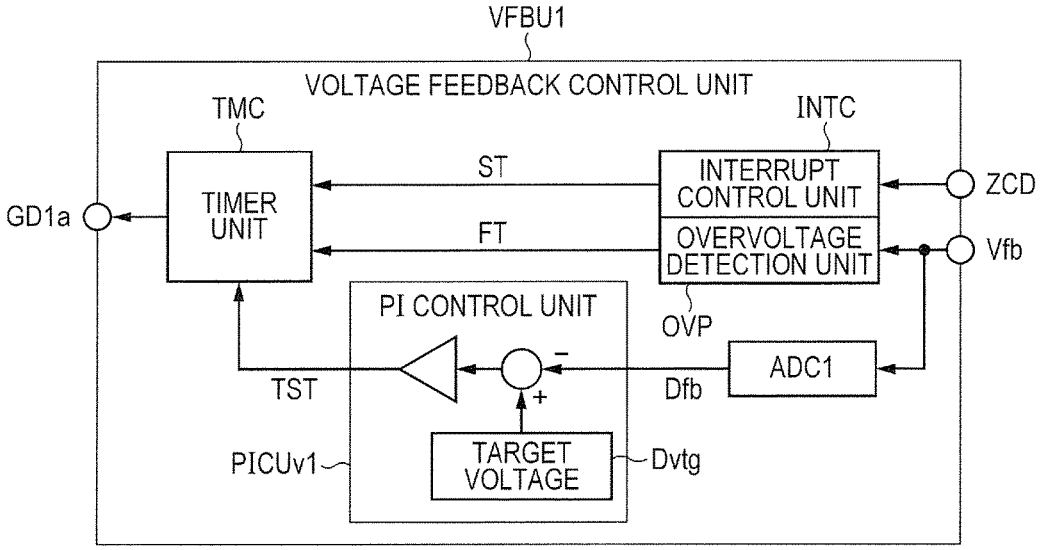
FIG. 6A is a block diagram showing a detailed configuration example of a main part of a voltage feedback control unit in FIG. 5.
Figure 6B:
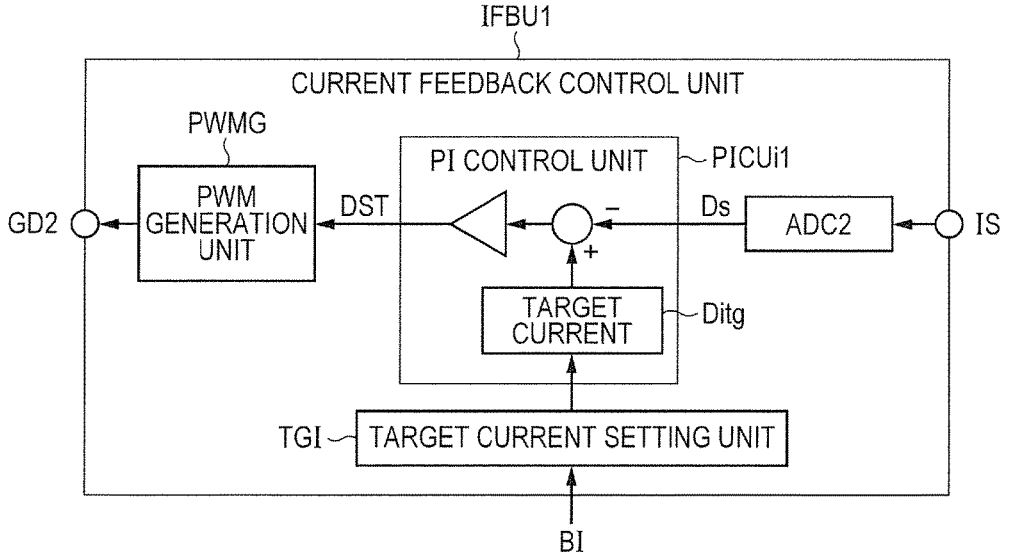
FIG. 6B is a block diagram showing a detailed configuration example of a main part of a current feedback control unit in FIG. 5.

FIG. 6A is a block diagram showing a detailed configuration example of a main part of the voltage feedback control unit in FIG. 5. FIG. 6B is a block diagram showing a detailed configuration example of a main part of the current feedback control unit in FIG. 5. The voltage feedback control unit VFBU1 shown in FIG. 6A includes an interrupt control unit INTC, an overvoltage detection unit OVP, a timer unit TMC, an analog/digital conversion unit ADC1, and a PI control unit PICUv1.

The interrupt control unit INTC receives the zero current detection signal ZCD and generates a start signal ST. For example, the interrupt control unit INTC receives a transition of the zero current detection signal ZCD to an "H" level (a level of the power supply voltage VDD) which is generated when the zero current is received and generates the start signal ST. The overvoltage detection unit OVP includes a comparator circuit and generates a forced stop signal when the feedback voltage Vfb exceeds a predetermined upper limit voltage.

The analog/digital conversion unit (a first analog/digital conversion unit) ADC1 converts the feedback voltage Vfb into a digital value (a first digital value) Dfb. In other words, the analog/digital conversion unit ADC1 converts the output voltage (a first voltage) Vo into the digital value Dfb proportional to the output voltage Vo. The PI control unit (a first digital control unit) PICUv1 calculates an error between the digital value Dfb and a target voltage digital value Dvtg representing a target of the output voltage Vo and determines the on-pulse period Ton of the first drive signal GD1*a* by a digital calculation using the error as an input. Here, the on-pulse period Ton is determined as a timer setting value TST.

The PI control unit (the first digital control unit) PICUv1 can be formed by software processing performed by a CPU (Central Processing Unit) or the like. More specifically, the PI control unit PICUv1 calculates the timer setting value TST, which is an operation amount U(n), by proportional (P)–integral (I) control. For example, an operation amount U(n) is calculated by an expression (1).

$$U(n)=U(n-1)+K_0 \cdot E(n)+K_1 \cdot E(n-1) \quad (1)$$

U(n) is the operation amount of this time and U(n−1) is the previous operation amount. E(n) is an error value of this time and is calculated by "(target voltage digital value Dvtg)−(digital value Dfb of this time)". E(n−1) is a previous error value and is calculated by "(target voltage digital value Dvtg)−(previous digital value Dfb)". $K_0$ and $K_1$ are coefficients which are control parameters (phase compensation parameters).

The timer unit TMC starts a count operation when receiving the start signal ST, and when the count operation reaches the timer setting value TST, the timer unit TMC stops the count operation and resets a count value. Then the timer unit TMC sets a period in which the timer unit TMC performs the count operation as the on-pulse period Ton of the first drive signal GD1*a*. The timer unit TMC forcibly stops the count operation from when the timer unit receives a forced stop signal FT to when generation of the forced stop signal FT is stopped. As a result, the first drive signal GD1*a* is fixed to an off level and the transistor G1 (the first switch SW1) is also fixed to off.

In this manner, the digital control is applied to the voltage feedback control unit VFBU1, so that it is possible to easily realize switching (selection) between the fixed pulse control unit PCU and the voltage feedback control unit VFBU1 according to the brightness as described above. In other words, for example, when the voltage feedback control unit VFBU1 includes a general analog circuit including an error amplifier circuit or the like, there is a risk that many artifices are required on the circuit in order to perform such switching (selection).

The current feedback control unit IFBU1 shown in FIG. 6B includes an analog/digital conversion unit ADC2, a PI control unit PICUi1, a target current setting unit TGI, and a PWM generation unit PWMG. The analog/digital conversion unit (a second analog/digital conversion unit) ADC2 converts the current detection voltage IS into a digital value (a second digital value) Ds. In other words, the analog/digital conversion unit ADC2 converts the drive current Id into the digital value Ds proportional to the drive current Id.

The target current setting unit TGI sets a target current digital value Ditg representing a target of the drive current Id according to the light control information BI. The PI control unit (a second digital control unit) PICUi1 calculates an error between the digital value Ds and the target current digital value Ditg and determines a PWM duty (a duty setting value DST) of the second drive signal GD2 by a digital calculation using the error as an input.

The PI control unit (the second digital control unit) PICUi1 can be formed by software processing performed by a CPU or the like. More specifically, the PI control unit PICUi1 performs calculation based on the expression (1) in the same manner as the PI control unit PICUv1 by defining the operation amount U(n) as the PWM duty (the duty setting value DST). The PWM generation unit PWMG generates the second drive signal GD2, which is the PWM signal, based on the duty setting value DST.

Figure 7:
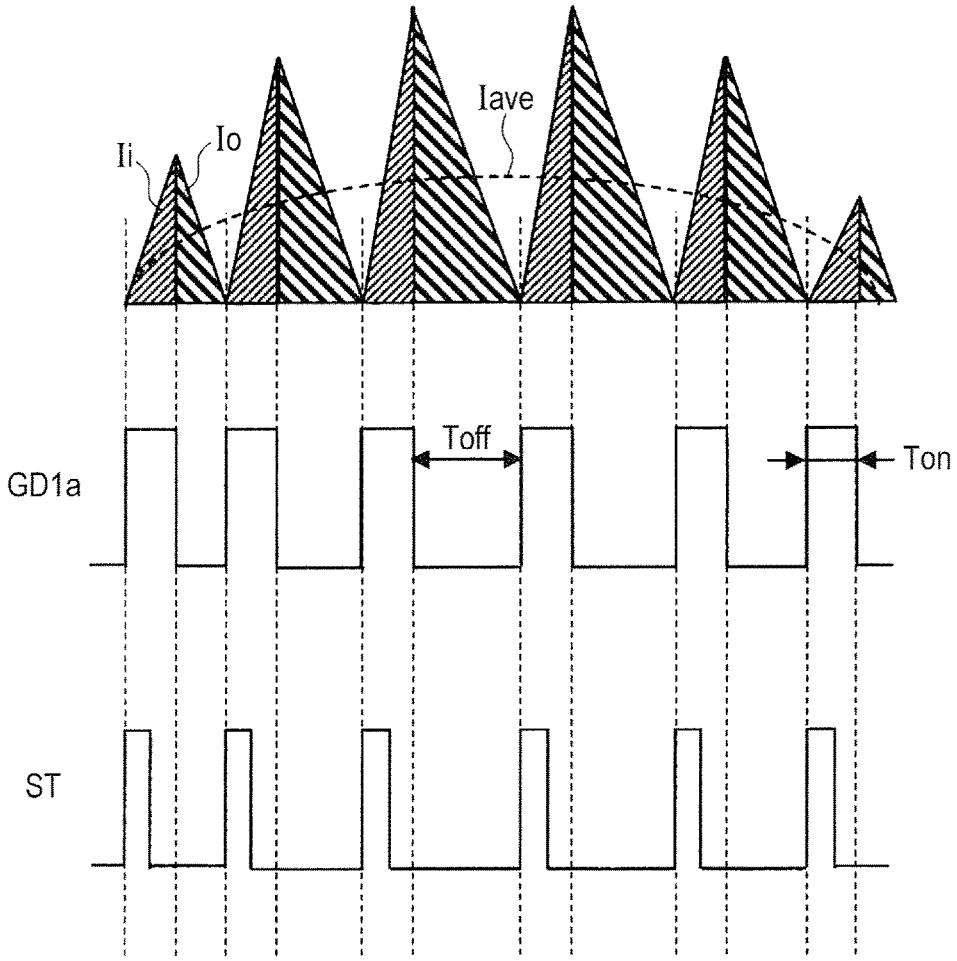
FIG. 7 is a waveform chart showing a schematic operation example of the voltage feedback control unit in FIG. 6A.

FIG. 7 is a waveform chart showing a schematic operation example of the voltage feedback control unit in FIG. 6A. As shown in FIG. 7, the voltage feedback control unit VFBU1 in FIG. 6A performs power factor improvement control (PFC control) by a so-called current critical mode. As shown in FIG. 7, during the on-pulse period Ton of the first drive signal GD1*a*, an input current Ii flows in the primary coil Lt1 in FIG. 5, and during the off-pulse period Toff, an output current Io flows in the secondary coil Lt2.

Here, when the output current Io of the secondary coil Lt2 becomes zero, the start signal ST is generated through the zero current detection signal ZCD. The first drive signal GD1*a* changes to an on level by receiving the start signal ST and maintains the on level during a period based on the timer setting value TST from the PI control unit PICUv1 (that is, during the on-pulse period Ton).

For example, in a stable state, the timer setting value TST from the PI control unit PICUv1 (the on-pulse period Ton) is maintained at substantially a constant value. Further, an inclination of the input current Ii in the on-pulse period Ton is proportional to the input voltage Vi. The input voltage Vi has a waveform of sinusoidal shape due to the rectifier DB, so that the inclination of the input current Ii increases or decreases by an amount of change based on the sinusoidal wave in a time series manner. Therefore, when the on-pulse period Ton is constant, an average current lave of the input current Ii is controlled to have a sinusoidal shape. As a result, it is possible to improve the power factor and to reduce higher harmonics with respect to the commercial power supply AC.

Here, the PI control unit PICUv1 and the PICUi1 are used as the first and the second digital control units. However, the first and the second digital control units are not particularly limited to those mentioned above. For example, it is also possible to use a PID control unit that performs proportional (P), integral (I), and differential (D) control.

Details of Fixed Pulse Control Unit

Figure 8:
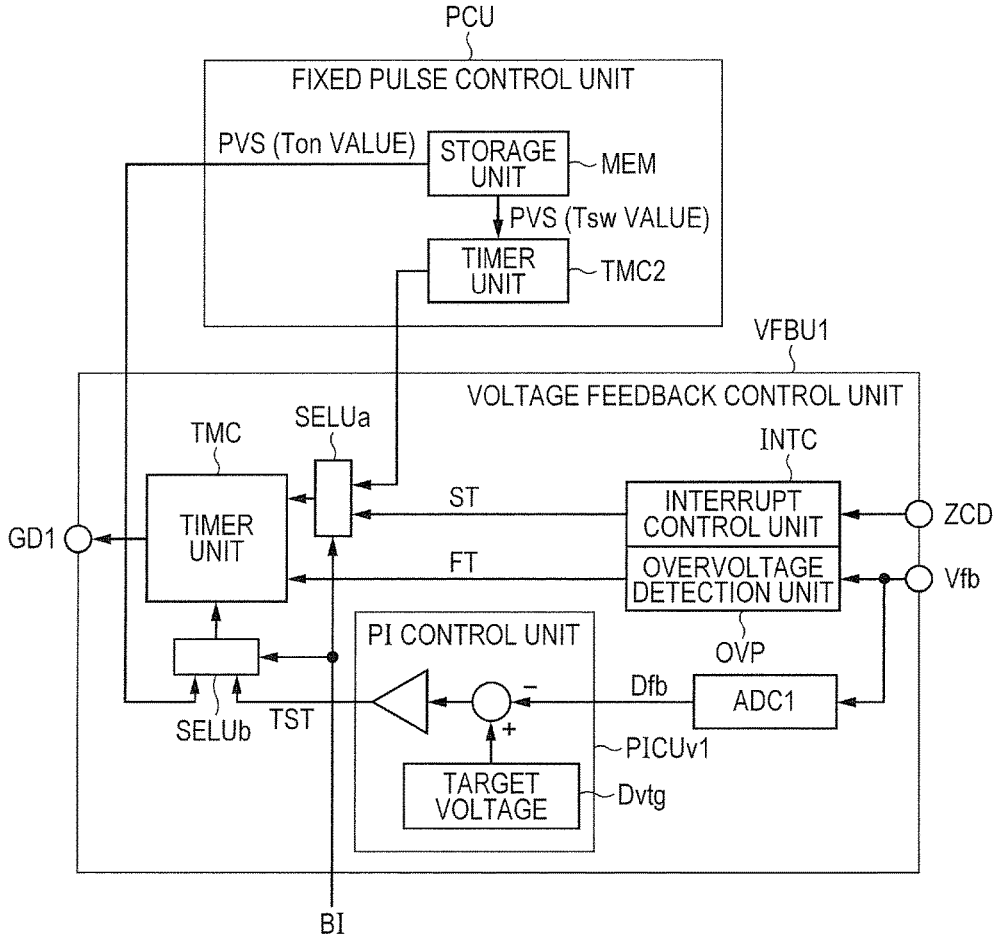
FIG. 8 is a block diagram showing a detailed configuration example around a fixed pulse control unit in FIG. 5.

FIG. 8 is a block diagram showing a detailed configuration example around the fixed pulse control unit in FIG. 5. As shown in FIG. 8, the fixed pulse control unit PCU can be generated by, for example, also using the timer unit TMC in the voltage feedback control unit VFBU1 shown in FIG. 6A. In the configuration example in FIG. 8, a selection unit SELUa is inserted in a path of the start signal in the voltage feedback control unit VFBU1 shown in FIG. 6A and a selection unit SELUb is inserted in a path of the timer setting value TST.

The fixed pulse control unit PCU includes the storage unit MEM that holds the voltage pulse setting value PVS described above and a timer unit TMC2. The cycle Tsw of the first drive signal GD1*b*, which is included in the voltage pulse setting value PVS, is set in the timer unit TMC. Timer unit TMC2 outputs a trigger signal every time the cycle Tsw is reached. Regarding the selection unit SELUa, the output from the timer unit TMC2 is inputted into one of two input ports and the start signal ST is inputted into the other of the two input ports. Regarding the selection unit SELUb, the on-pulse period Ton of the first drive signal GD1*b*, which is included in the voltage pulse setting value PVS, is inputted into one of two input ports and the timer setting value TST is inputted into the other of the two input ports.

Thereby, when the selection units SELUa and SELUb select one of the two inputs based on the light control information BI, the timer unit TMC generates the on-pulse period Ton based on the fixed pulse control unit PCU and the first drive signal GD1 having the cycle Tsw. On the other hand, when the selection units SELUa and SELUb select the other of the two inputs based on the light control information BI, the timer unit TMC generates the first drive signal GD1*a* described in FIG. 6A as the first drive signal GD1 in FIG. 8.

Here, even in a period in which the selection units SELUa and SELUb select the fixed pulse control unit PCU, it is possible to quickly take an action when the switching of the selection units SELUa and SELUb is performed as described in FIGS. 3 and 4 by causing the PI control unit PICUv1 to operate continuously. Further, the power consumption is small during the low brightness light control, so that the higher harmonics with respect to the commercial power supply AC do not cause a problem in particular. Therefore, the PFC control is not necessary during the low brightness light control, so that there is no problem in particular even when fixed on-pulse period Ton and cycle Tsw are used.

Here, a configuration example is shown in which the cycle Tsw is determined by the voltage pulse setting value PVS. However, in some cases, it is possible to determine the cycle Tsw by the start signal ST without providing the selection unit SELUa. Further, the fixed pulse control unit PCU is not necessarily limited to the method as shown in FIG. 8, but the fixed pulse control unit PCU can be realized by various methods. For example, it is possible to employ a method in which another PWM generation unit having the same function as that of the PWM generation unit PWMG shown in FIG. 6B and a PWM period and a PWM duty based on the voltage pulse setting value PVS are set in the PWM generation unit. Further, the selection unit SELUa and SELUb shown in FIG. 8 (and the selection unit SELU in FIG. 5 and the like corresponding to the selection unit SELUa and SELUb) may be formed by software processing performed by a CPU or the like or may be formed by hardware such as a multiplexer.

External Form of LED Drive Device

Figure 9A:
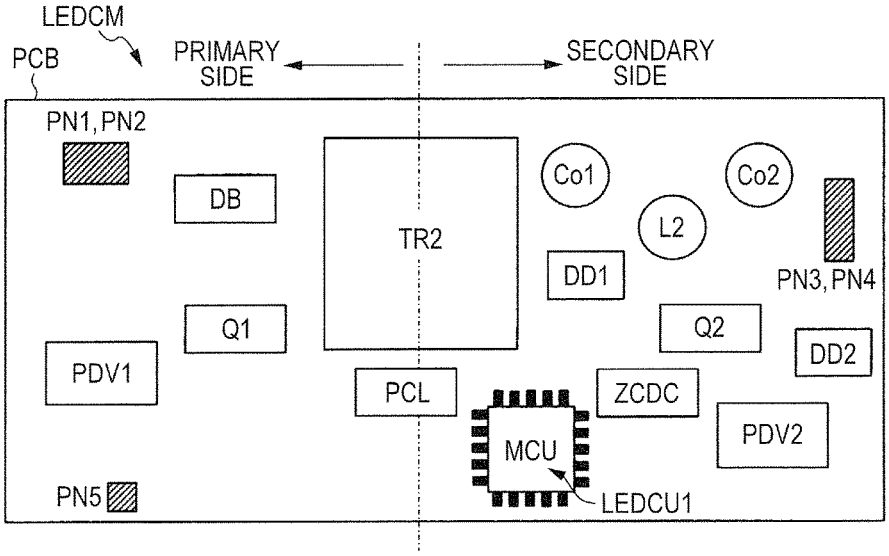
FIG. 9A is a plan view showing a schematic external form example of the LED drive device in FIG. 5.
Figure 9B:
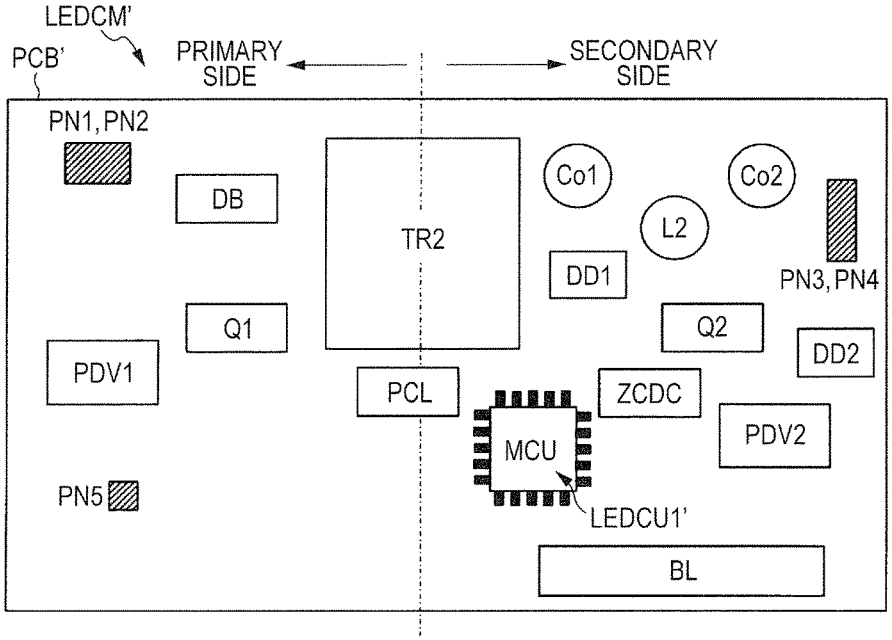
FIG. 9B is a plan view showing a schematic external form example of an LED drive device of a comparative example of FIG. 9A.

FIG. 9A is a plan view showing a schematic external form example of the LED drive device in FIG. 5. FIG. 9B is a plan view showing a schematic external form example of an LED drive device of a comparative example of FIG. 9A. The LED drive module (the LED drive device) LEDCM shown in FIG. 9A includes a wiring substrate PCB and various components mounted over the wiring substrate PCB. Although the various components are all the components that are shown in the configuration example shown in FIG. 5, only main components of all the components are shown in FIGS. 9A and 9B for convenience.

The transformer TR2 is mounted near the center of the wiring substrate PCB. Various components provided on a primary side of the transformer TR2 are mounted on one side as seen from the transformer TR2, and various components provided on a secondary side of the transformer TR2 are mounted on the other side. The various components provided on the primary side of the transformer TR2 include the rectifier DB, the transistor Q1, the pre-driver circuit PDV1, the photocoupler PCL, and the like. In the primary side of the transformer TR2, the external terminals PN1, PN2, and PN5 are provided.

On the other hand, the various components provided on the secondary side of the transformer TR2 include the zero current detection circuit ZCDC, the smoothing capacitors Co1 and Co2, the diodes DD1 and DD2, the transistor Q2, the pre-driver circuit PDV2, the coil L2, and the like. In the secondary side of the transformer TR2, the external terminals PN3 and PN4 are provided. Further, here, an IC chip (a semiconductor chip) of a micro control unit (MCU) that forms the LED control unit LEDCU1 is mounted near the center of the wiring substrate PCB.

In such a configuration example, for example, when a method as shown in Japanese Unexamined Patent Application Publication No. 2014-13866 described above is used, it is necessary to secure amounting area of a bleeder circuit BL in the secondary area of the transformer TR2 as shown in an LED drive device LEDCM' in FIG. 9B. In the bleeder circuit BL, for example, a bleeder resistance of a metal oxide film resistor rated at several watts is used. Therefore, there is a risk that the size and the cost of the LED drive device LEDCM' increase. On the other hand, when the method of the first embodiment is used, as shown in FIG. 9A, the bleeder circuit BL is not required, so that it is possible to reduce the size and the cost of the LED drive device LEDCM'.

As described above, by using the LED drive system, the LED drive device, and the LED drive method of the first embodiment, it is possible to realize, typically, reduction of the flicker when the LED is in a low brightness state and the reduction of the size of the LED drive device. Further, it is possible to realize the reduction of the flicker when the LED is in a low brightness state and the reduction of the power consumption of the LED drive device and the like.

Second Embodiment

Schematic Configuration of LED Drive System (Modified Example [1])

Figure 10:
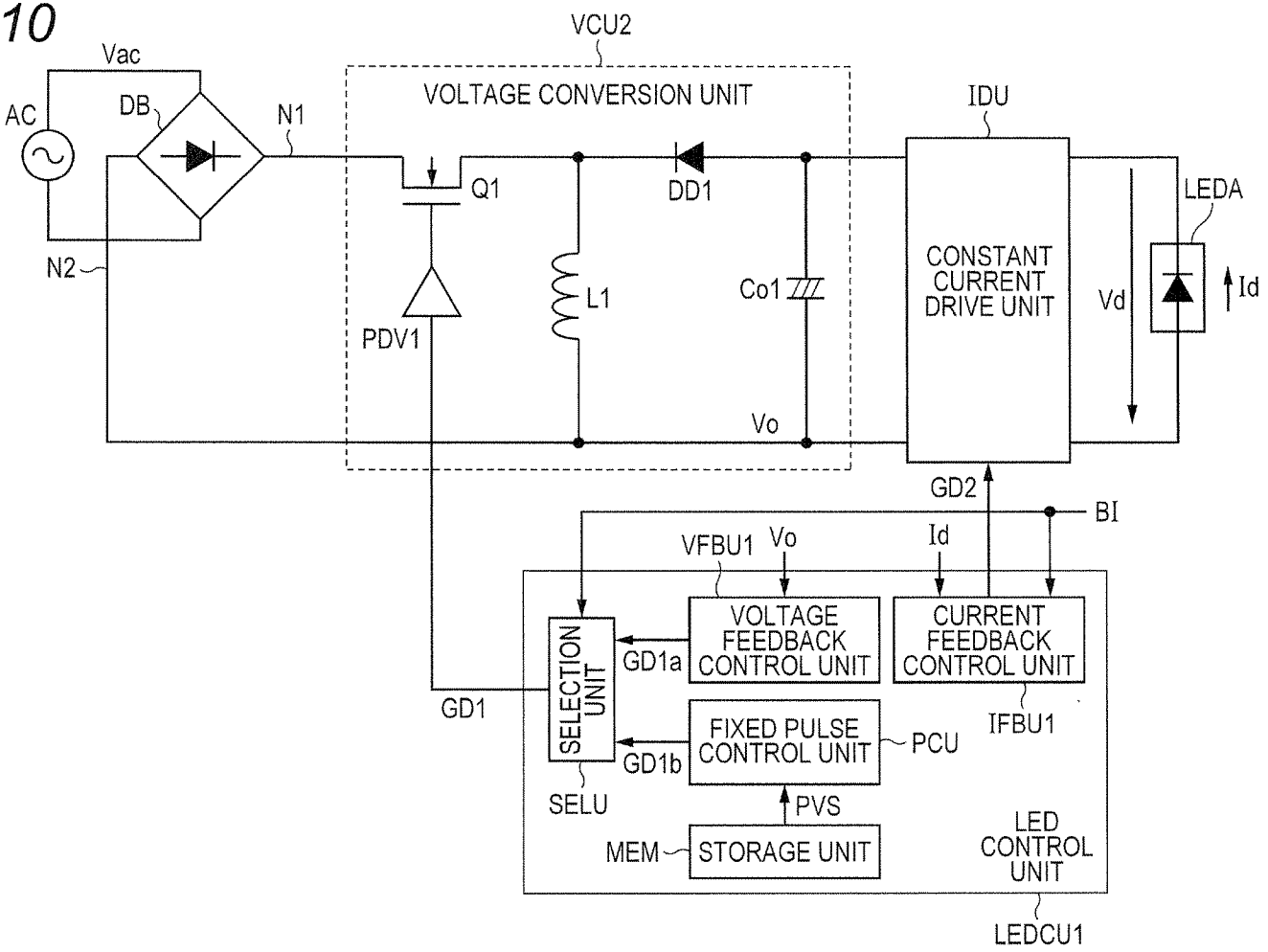
FIG. 10 is a circuit block diagram showing a schematic configuration example of an LED drive system according to a second embodiment of the present invention.

FIG. 10 is a circuit block diagram showing a schematic configuration example of an LED drive system according to a second embodiment of the present invention. In the LED drive system shown in FIG. 10, the configuration of a voltage conversion unit VCU2 is different from that in the configuration example in FIG. 1. The configuration other than the above is the same as that in FIG. 1, so that detailed description will be omitted.

A voltage conversion unit VCU2 in FIG. 10 has a non-insulated type configuration, which is different from an insulated type configuration of the voltage conversion unit VCU (that is, a configuration in which the transformer TR1 is used) in FIG. 1. The voltage conversion unit VCU2 includes the transistor Q1 (the first switch SW1), the coil L1, the diode DD1, the smoothing capacitor Co1, and the pre-driver circuit PDV1. The transistor Q1 is provided between a node N1 which is one output node of the rectifier DB and the cathode of the diode DD1.

The coil L1 is provided between the cathode of the diode DD1 and a node N2 which is the other output node of the rectifier DB. The smoothing capacitor Co1 is provided between the anode of the diode DD1 and the node N2. The pre-driver circuit PDV1 controls on/off of the transistor Q1 according to the first drive signal GD1 from the LED control unit LEDCU1. The voltage conversion unit VCU2 is an inversion-type step-down converter and generates an output voltage (a first voltage) Vo at the node N2 by causing the anode of the diode DD1 to have the ground voltage. Accordingly, in FIG. 10, the LED array LEDA is coupled to the constant current drive unit IDU in a direction opposite to that in the case of FIG. 1.

For example, even when the non-insulated type voltage conversion unit VCU2 as described above is used, the method of the first embodiment can be applied, and thereby it is possible to obtain the same effect as that of the first embodiment.

Third Embodiment

Schematic Configuration of LED Drive System (Modified Example [2])

Figure 11:
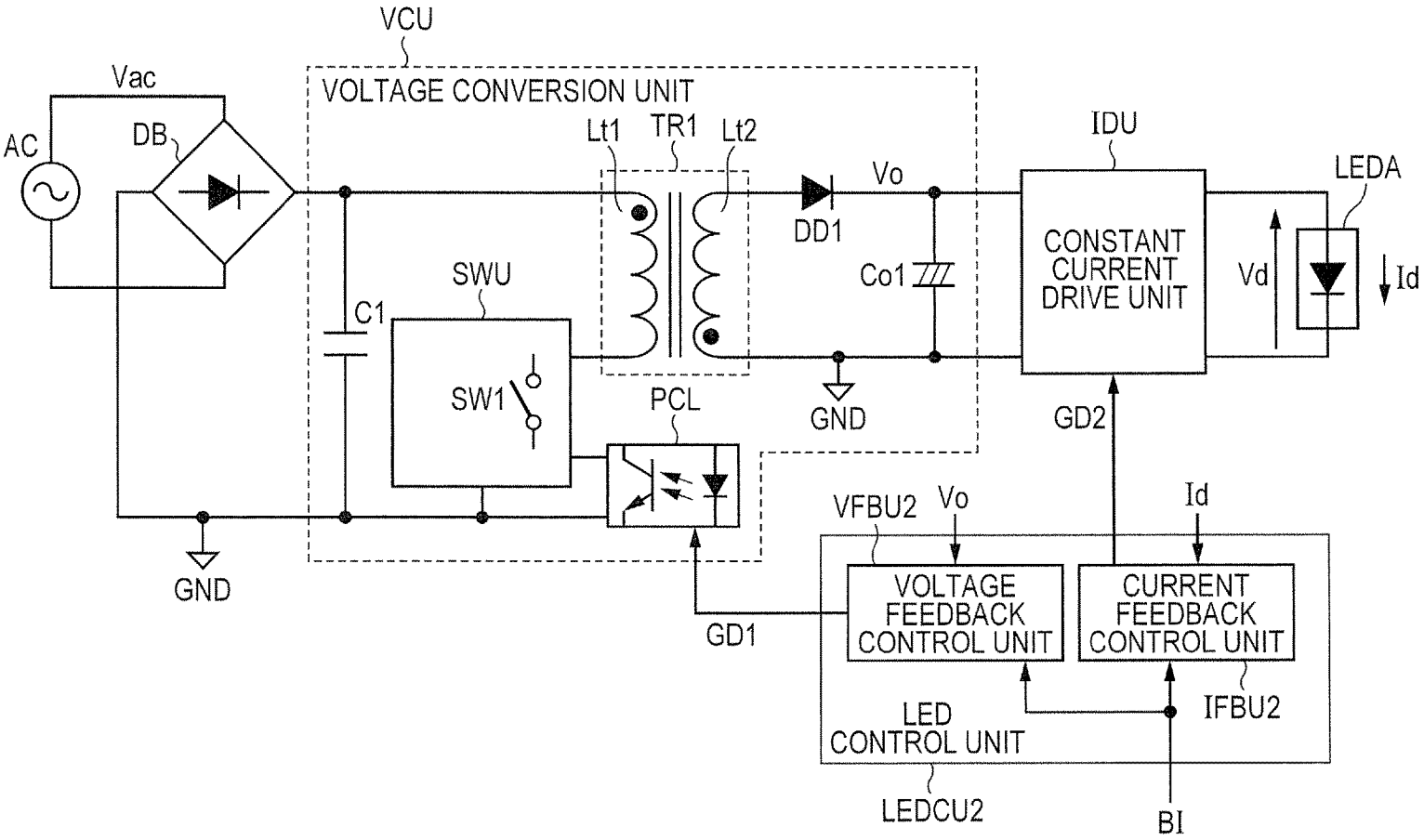
FIG. 11 is a circuit block diagram showing a schematic configuration example of an LED drive system according to a third embodiment of the present invention.

FIG. 11 is a circuit block diagram showing a schematic configuration example of an LED drive system according to a third embodiment of the present invention. In the LED drive system shown in FIG. 11, the configuration of an LED control unit LEDCU2 is different from that in the configuration example in FIG. 1. The configuration other than the above is the same as that in FIG. 1, so that detailed description will be omitted.

The LED control unit LEDCU2 includes a voltage feedback control unit VFBU2 and a current feedback control unit IFBU2, but does not include the fixed pulse control unit PCU, which is included in FIG. 1. The voltage feedback control unit VFBU2 receives the output voltage Vo and the light control information BI and performs control operations. The current feedback control unit IFBU2 receives the drive current Id of the LED array LEDA and the light control information BI and performs control operations.

Details of Voltage Feedback Control Unit and Current Feedback Control Unit Modified Example ([2])

Figure 12:
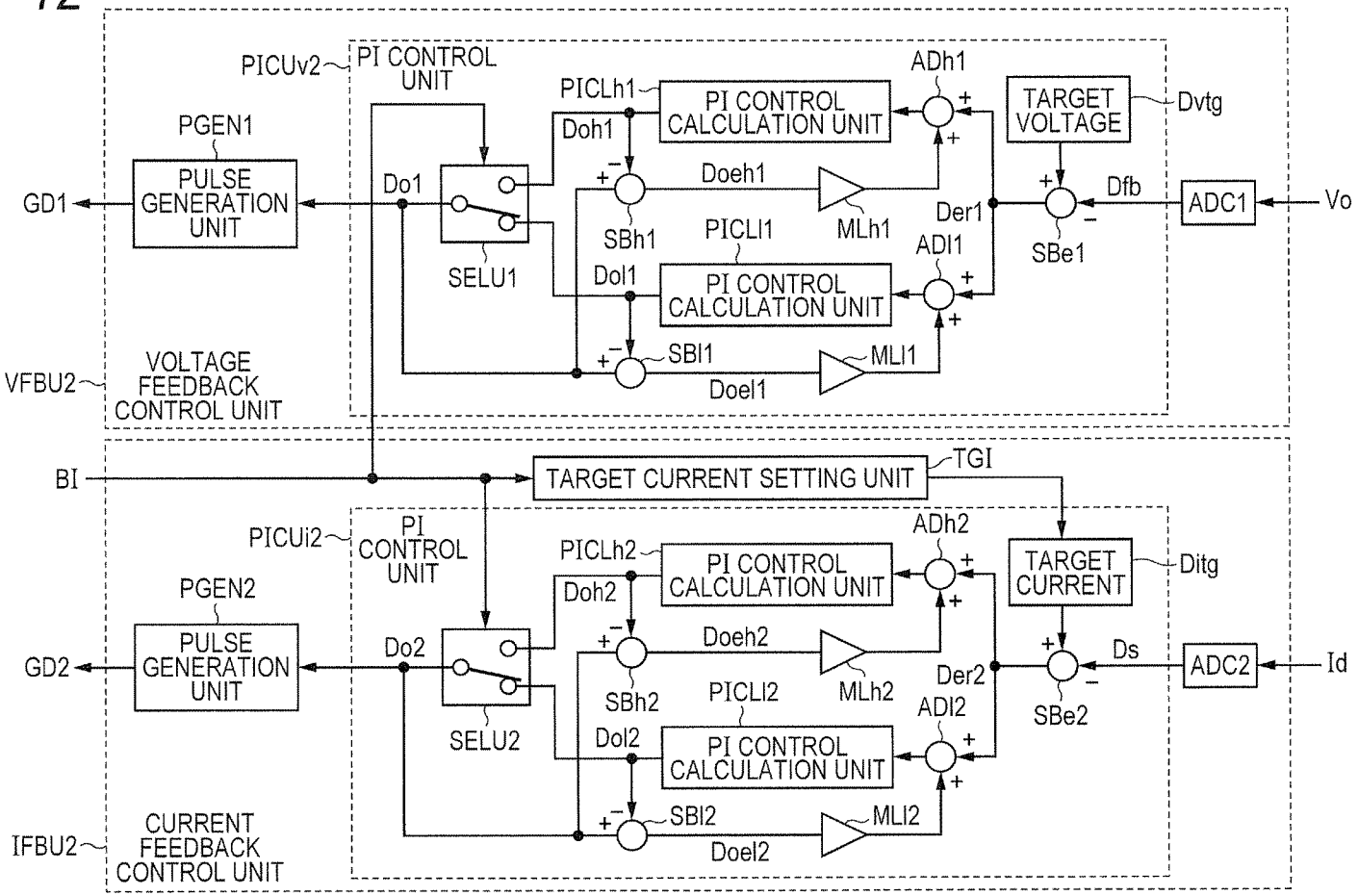
FIG. 12 is a block diagram showing a detailed configuration example of main parts of a voltage feedback control unit and a current feedback control unit in FIG. 11.

FIG. 12 is a block diagram showing a detailed configuration example of main parts of the voltage feedback control unit and the current feedback control unit in FIG. 11. The voltage feedback control unit VFBU2 includes the analog/digital conversion unit (the first analog/digital conversion unit) ADC1, a PI control unit PICUv2, and a pulse generation unit PGEN1. The analog/digital conversion unit (the first analog/digital conversion unit) ADC1 converts the output voltage Vo into a digital value. However, the output voltage Vo is a high voltage, so that in practice, the analog/digital conversion unit ADC1 converts the output voltage Vo into a digital value (a first digital value) Dfb proportional to the output voltage Vo by using the feedback voltage Vfb and the like in the same manner as in the case of FIG. 6A.

Different from the case in FIG. 6A, the PI control unit PICUv2 includes two PI control calculation units PICLh1 and PICLl1, two addition units ADh1 and ADl1, two subtraction units SBh1 and SBl1, two multiplication units MLh1 and MLl1, a selection unit SELU1, and a subtraction unit SBe1. The subtraction unit (a first error calculating unit) SBe1 calculates a digital value (a first error digital value) Der1, which is an error between the digital value Dfb and a target voltage digital value Dvtg representing a target of the output voltage Vo.

The selection unit (a first selection unit) SELU1 selects a digital value Doh1 outputted from the PI control calculation unit (a first calculation unit) PICLh1 in a first case in which the brightness based on the light control information BI is higher than predetermined reference brightness. On the other hand, the selection unit SELU1 selects a digital value Dol1 outputted from the PI control calculation unit (a second calculation unit) PICLl1 in a second case in which the brightness based on the light control information is lower than the reference brightness.

The subtraction unit (a first output error calculating unit) SBh1 calculates a digital value (a first output error digital value) Doeh1, which is an error between the digital value Doh1 outputted from the PI control calculation unit PICLh1 and a digital value Do1 selected by the selection unit SELU1. The subtraction unit (a second output error calculating unit) SBl1 calculates a digital value (a second output error digital value) Doel1, which is an error between the digital value Dol1 outputted from the PI control calculation unit PICLl1 and a digital value Do1 selected by the selection unit SELU1.

Roughly, the PI control calculation unit (the first calculation unit) PICLh1 calculates the digital value Doh1 by a digital calculation using an addition result of the digital value (the first error digital value) Der1 and the digital value (the first output error digital value) Doeh1 as an input. More specifically, the digital value Doeh1 is multiplied by the multiplication unit MLh1. The addition unit ADh1 adds a digital value outputted from the multiplication unit MLh1 and the digital value Der1 and outputs the addition result to the PI control calculation unit PICLh1. The PI control calculation unit PICLh1 outputs the digital value Doh1 by using the output of the addition unit ADh1 as an input.

In the same manner, roughly, the PI control calculation unit (the second calculation unit) PICLl1 calculates the digital value Dol1 by a digital calculation using an addition result of the digital value (the first error digital value) Der1 and the digital value (the second output error digital value) Doel1 as an input. More specifically, the digital value Doel1 is multiplied by the multiplication unit MLl1. The addition unit ADl1 adds a digital value outputted from the multiplication unit MLl1 and the digital value Der1 and outputs the addition result to the PI control calculation unit PICLl1. The PI control calculation unit PICLl1 outputs the digital value Dol1 by using the output of the addition unit ADl1 as an input.

The pulse generation unit (a first drive signal generation unit) PGEN1 generates the first drive signal GD1 based on the digital value Do1 selected by the selection unit SELU1. The pulse generation unit PGEN1 can be formed by, for example, the timer unit TMC as shown in FIG. 6A or, in some cases, can be formed by the PWM generation unit PWMG as shown in FIG. 6B. When the pulse generation unit PGEN1 is formed by the timer unit TMC, for example, in the same manner as in the case of FIG. 6A, the start signal ST should be generated by using the interrupt control unit INTC or the like and it should be configured so that the digital value Do1 becomes a timer setting value. On the other hand, when the pulse generation unit PGEN1 is formed by the PWM generation unit PWMG, it should be configured so that the digital value Do1 becomes the PWM duty.

Although not particularly limited, each of the PI control calculation units PICLh1 and PICLl1 performs a digital calculation by, for example, using the expression (1) in the same manner as in the case of the PI control unit PICUv1 in FIG. 6A. However, here, E(n) in the expression (1) is the digital value outputted this time from the addition unit ADh1, and the E(n−1) is the digital value outputted previous time from the addition unit ADh1.

Here, as described in FIG. 17B, for example, when the phase compensation parameters represented by the coefficients $K_0$ and $K_1$ in the expression 1 are fixed values, there is a case in which sufficient control of the output voltage Vo can be performed only in a part of arrangement range of the drive current Id (in other words, the brightness) and cannot be performed in the entire arrangement range. Mainly because of the above situation, the intermittent operation as shown in FIG. 17B is performed and there may be variation of the output voltage Vo. Therefore, the PI control unit PICUv2 in FIG. 12 includes the two PI control calculation units PICLh1 and PICLl1.

When the brightness based on the light control information BI is higher than the reference brightness (in other words, when load is heavy), the phase compensation parameters (the coefficients $K_0$ and $K_1$) are set so that the PI control calculation unit PICLh1 can sufficiently control the output voltage Vo. On the other hand, when the brightness based on the light control information BI is lower than the reference brightness (in other words, when load is light), the phase compensation parameters (the coefficients $K_0$ and $K_1$) are set so that the PI control calculation unit PICLl1 can sufficiently control the output voltage Vo. Specifically, for example, the two phase compensation parameters are set so that the control band (the zero crossing frequency) is the same in each corresponding load condition.

By using such a PI control unit PICUv2, the intermittent operation as shown in FIG. 17B is not performed, so that it is possible to sufficiently reduce the variation of the output voltage Vo. As a result, it is possible to reduce the flicker of the LED.

Further, for example, the PI control calculation unit PICLh1 performs digital calculation by using the output of the addition unit ADh1 instead of the output of the subtraction unit SBe1 used as in the case of FIG. 6A. For example, a case assumed in which the digital value Dol1 from the PI control calculation unit PICLl1 is currently selected by the selection unit SELU1. In this case, a digital value obtained by adding an error (the digital value Der1) from the target voltage to an error between the output (the digital value Doh1) of the PI control calculation unit PICLh1 and the output (the digital value Dol1) of the PI control calculation unit PICLl1 is inputted into the PI control calculation unit PICLh1.

The PI control calculation unit PICLh1 calculates a new digital value Doh1 for causing the error obtained by the addition to be close to zero. Therefore, the error between the digital value Doh1 and the digital value Dol1 becomes small. As a result, it is possible to suppress rapid variation of the digital value Do1 which may occur when a selection destination of the selection unit SELU1 is switched. In other words, when the rapid variation of the digital value Do1 occurs, this may cause the flicker of the LED. It is possible to prevent this kind of situation by using the PI control unit PICUv2.

The current feedback control unit IFBU2 includes the analog/digital conversion unit (the second analog/digital conversion unit) ADC2, a PI control unit PICUi2, a pulse generation unit PGEN2, and the target current setting unit TGI. The analog/digital conversion unit (the second analog/digital conversion unit) ADC2 converts the drive current Id into a digital value. However, in practice, the analog/digital conversion unit ADC2 converts the drive current Id into a digital value (a second digital value) Ds proportional to the drive current Id by using the current detection voltage IS and the like in the same manner as in the case of FIG. 6B.

The target current setting unit TGI sets a target current digital value Ditg representing a target of the drive current Id according to the light control information BI. The PI control unit PICUi2 includes two PI control calculation units PICLh2 and PICLl2, two addition units ADh2 and ADl2, two subtraction units SBh2 and SBl2, two multiplication units MLh2 and MLl2, a selection unit SELU2, and a subtraction unit SBe2. The configuration and the operation of the PI control unit PICUi2 are the same as those of the PI control unit PICUv2, so that only the configuration will be simply described below.

The subtraction unit (a second error calculating unit) SBe2 calculates a digital value (a second error digital value) Der2, which is an error between the digital value Ds and a target current digital value Ditg. The selection unit (a second selection unit) SELU2 selects a digital value Doh2 outputted from the PI control calculation unit (a third calculation unit) PICLh2 in the first case described above, selects a digital value Dol2 outputted from the PI control calculation unit (a fourth calculation unit) PICLl2, and outputs the selected digital value Do2.

The subtraction unit (a second output error calculating unit) SBh2 calculates a digital value (a third output error digital value) Doeh2, which is an error between the digital value Doh2 and the digital value Do2. The subtraction unit (a fourth output error calculating unit) SBl2 calculates a digital value (a fourth output error digital value) Doel2, which is an error between the digital value Dol2 and the digital value Do2.

Roughly, the PI control calculation unit (the third calculation unit) PICLh2 calculates the digital value Doh2 by a digital calculation using an addition result of the digital value Der2 and the digital value Doeh2 as an input. More specifically, the digital value Doeh2 is multiplied by the multiplication unit MLh2. The addition unit ADh2 adds a digital value outputted from the multiplication unit MLh2 and the digital value Der2 and outputs the addition result to the PI control calculation unit PICLh2. The PI control calculation unit PICLh2 outputs the digital value Doh2 by using the output of the addition unit ADh2 as an input.

In the same manner, roughly, the PI control calculation unit (the fourth calculation unit) PICLl2 calculates the digital value Dol2 by a digital calculation using an addition result of the digital value Der2 and the digital value Doel2 as an input. More specifically, the digital value Doel2 is multiplied by the multiplication unit MLl2. The addition unit ADl2 adds a digital value outputted from the multiplication unit MLl2 and the digital value Der2 and outputs the addition result to the PI control calculation unit PICLl2. The PI control calculation unit PICLl2 outputs the digital value Dol2 by using the output of the addition unit ADl2 as an input.

The pulse generation unit (a second drive signal generation unit) PGEN2 generates the second drive signal GD2 based on the digital value Do2 selected by the selection unit SELU2. The pulse generation unit PGEN2 can be formed by, for example, the PWM generation unit PWMG as shown in FIG. 6B. In this case, the digital value Do2 becomes the PWM duty.

It is possible to realize reduction of the flicker of the LED by using, in particular, the voltage feedback control unit VFBU2 as shown in FIG. 12. Further, in some cases, it is possible to realize the reduction of the flicker by using the current feedback control unit IFBU2 as shown in FIG. 12. The current feedback control unit IFBU2 in FIG. 12 includes two PI control calculation units PICLh2 and PICLl2, so that the current feedback control unit IFBU2 has some responsiveness to variation of the output voltage Vo and can maintain the drive current Id at a constant level to some extent. Therefore, it is more desirable to use the current feedback control unit IFBU2 in addition to using at least the voltage feedback control unit VFBU2.

As another effect, the operation amount U(n) is optimized in a large adjustable range by using the two PI control calculation units, so that it is possible to improve adjustability toward a target value. The improvement of adjustability is particularly useful in the current feedback control unit IFBU2 which is required to precisely adjust the drive current Id according to the brightness. Therefore, from a viewpoint of realizing reduction of the flicker of the LED and improvement of the adjustability, it is desirable to use both the voltage feedback control unit VFBU2 and the current feedback control unit IFBU2.

As described above, by using the LED drive system, the LED drive device, and the LED drive method of the third embodiment, it is possible to obtain the same effect as that of the first embodiment in addition to the effect of improvement of the adjustability described above. In other words, the bleeder circuit is not required, so that it is possible to reduce the size, the cost, and the power consumption of the LED drive device and the like. The PI control unit PICUv2 and the PICUi2 shown in FIG. 12 can be realized by software processing of a CPU or the like, so that the circuit scale and the cost do not increase particularly. Further, although two PI control calculation units are used here, it is possible to use there or more PI control calculation units can be used in the same manner.

Fourth Embodiment

Schematic Configuration of LED Drive System (Modified Example [3])

Figure 13:
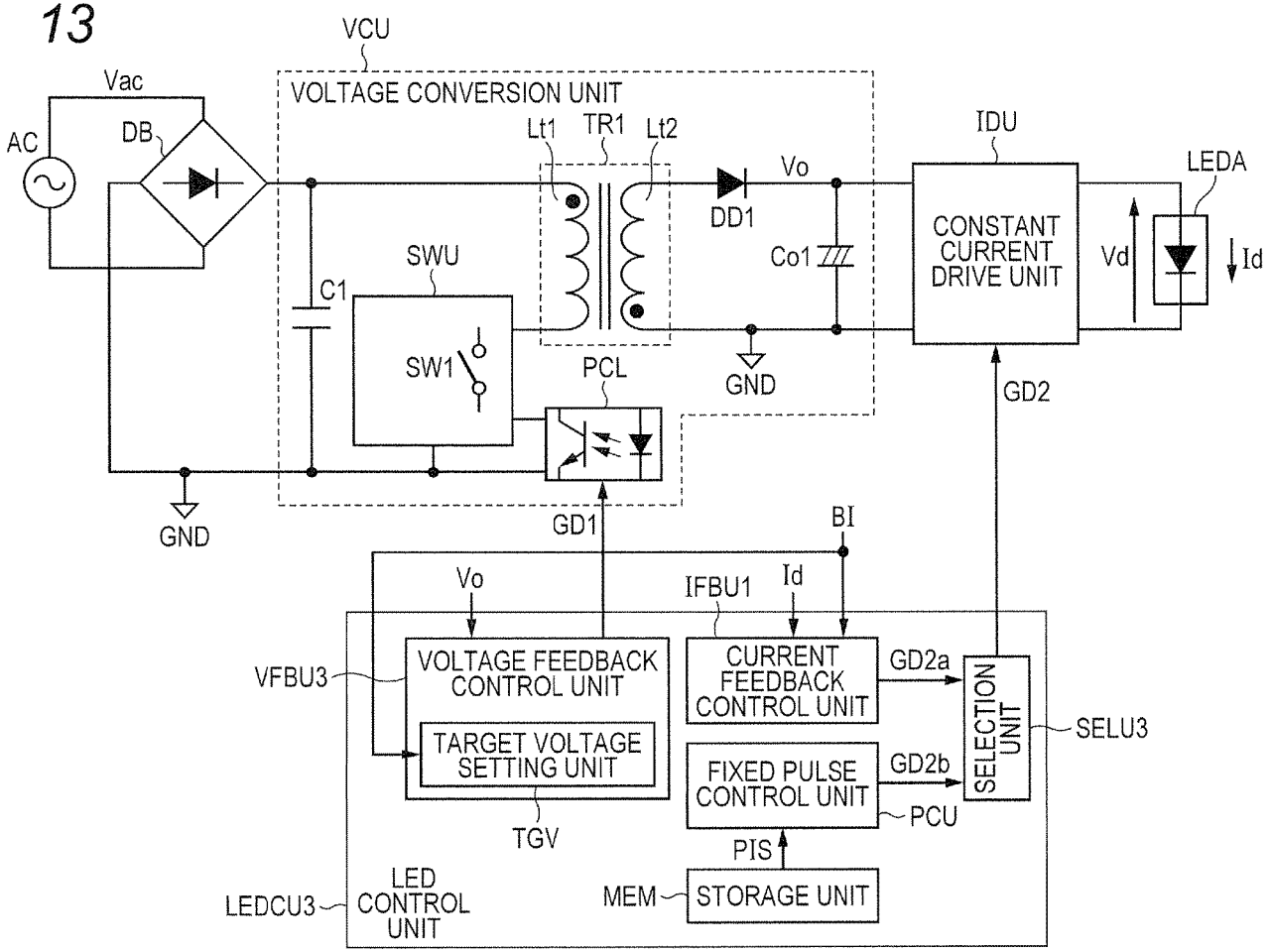
FIG. 13 is a circuit block diagram showing a schematic configuration example of an LED drive system according to a fourth embodiment of the present invention.

FIG. 13 is a circuit block diagram showing a schematic configuration example of an LED drive system according to a fourth embodiment of the present invention. In the LED drive system shown in FIG. 13, the configuration of an LED control unit LEDCU3 is different from that in the configuration example in FIG. 1. The configuration other than the above is the same as that in FIG. 1, so that detailed description will be omitted.

The LED control unit LEDCU3 includes a voltage feedback control unit VFBU3, the current feedback control unit IFBU1, the fixed pulse control unit PCU, a selection unit SELU3, and the storage unit MEM. Different from the case in FIG. 1, in the second case in which the brightness based on the light control information BI is lower than the reference brightness, the fixed pulse control unit PCU generates a second drive signal GD2*b* having a predetermined fixed PWM cycle and PWM duty. The fixed PWM cycle and PWM duty are held in the storage unit MEM as a current pulse setting value PIS in advance.

Different from the case in FIG. 1, the selection unit SELU3 selects either one of a second drive signal GD2*a* from the current feedback control unit IFBU1 and the second drive signal GD2*b* from the fixed pulse control unit PCU and outputs the selected second drive signal GD2 to the second switch (for example, the transistor Q2 in FIG. 5) in the constant current drive unit IDU. Specifically, the selection unit SELU3 determines whether the brightness based on the light control information BI is higher than or lower than predetermined reference brightness. The selection unit SELU3 selects the second drive signal GD2*a* in a first case in which the brightness is higher than the reference brightness and selects the second drive signal GD2*b* in a second case in which the brightness is lower than the reference brightness.

The voltage feedback control unit VFBU3 has the same configuration as that in FIG. 1. However, here, the voltage feedback control unit VFBU3 additionally includes a target voltage setting unit TGV. The target voltage setting unit TGV sets a target voltage representing a target of the output voltage (the first voltage) Vo according to the light control information BI. Then, the voltage feedback control unit VFBU3 generates the first drive signal GD1 based on an error between the output voltage Vo and the target voltage. The configuration and the operation of the current feedback control unit IFBU1 are the same as those in FIG. 1.

During the low brightness light control, the drive current Id of the LED array LEDA is small with respect to the target voltage of the output voltage Vo, so that the intermittent operation as shown in FIG. 17B occurs and the flicker of the LED occurs. As a countermeasure for this, for example, it is considered to lower the target voltage of the output voltage Vo. However, in this case, the prerequisite for the current feedback control unit IFBU1 changes, so that the feedback control may be unstable.

Therefore, as shown in FIG. 13, during the low brightness light control, the second drive signal GD2*a* from the current feedback control unit IFBU1 is not used, and the second drive signal GD2*b* having the PWM cycle and the PWM duty which are fixed by the fixed pulse control unit PCU is used. Then, along with this, the target voltage of the voltage feedback control unit VFBU3 is variably controlled according to the brightness based on the light control information BI.

Thereby, it is possible to reduce the flicker of the LED. Further, as another effect, it is possible to variably control the current value of the drive current Id based on the variable control of the output voltage Vo in a state in which the second drive signal GD2*b* is fixed during the low brightness light control. When using such a method, during the low brightness light control, for example, it may be possible to realize adjustment of the current value of the drive current Id according to the brightness at higher resolution than in a case in which the configuration example of FIG. 1 is used.

Operation of Main Part of LED Control Unit (Modified Example [3])

Figure 14:
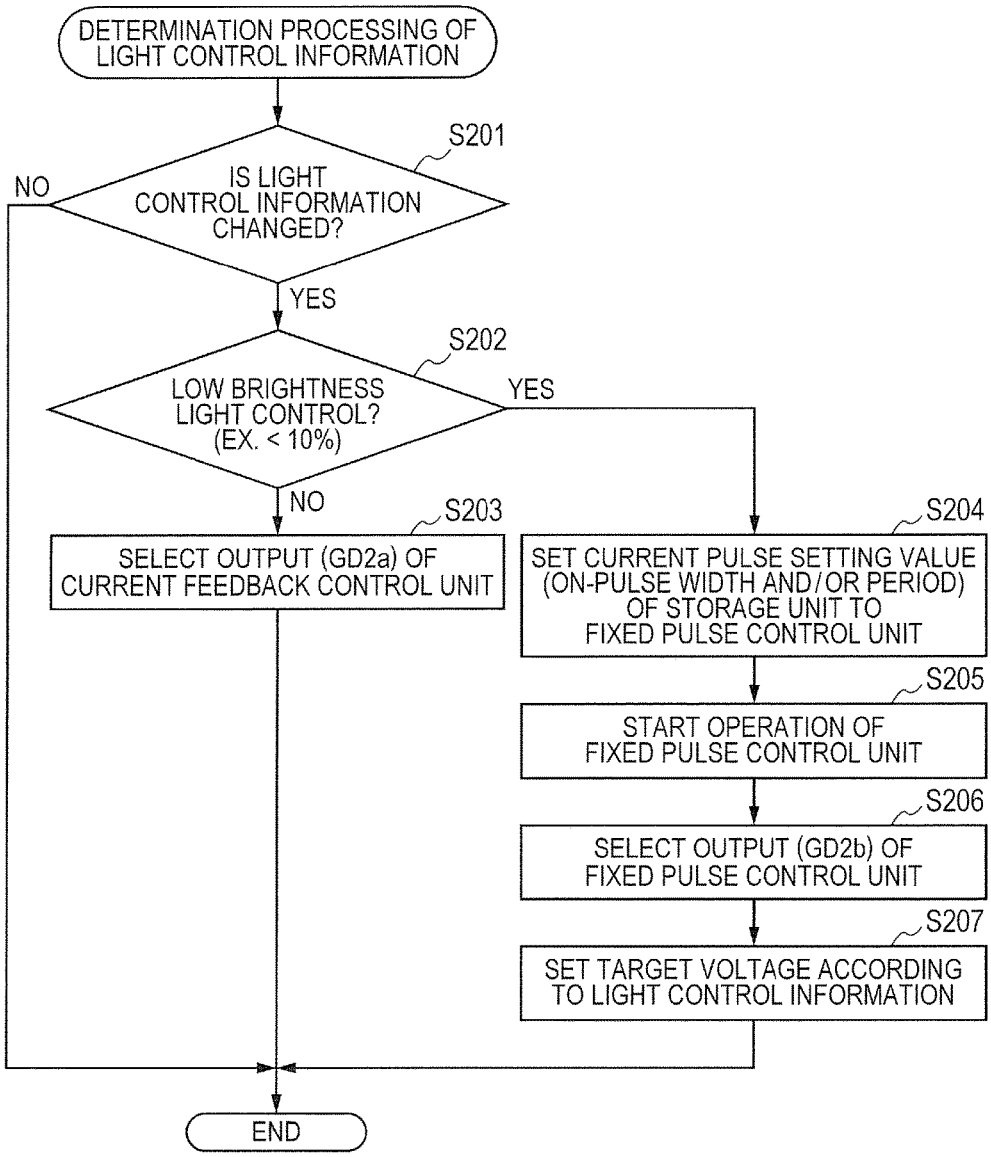
FIG. 14 is a flowchart showing an operation example of a main part of an LED control unit in the LED drive system in FIG. 13.

FIG. 14 is a flowchart showing an operation example of a main part of the LED control unit in the LED drive system in FIG. 13. As shown in FIG. 14, the LED control unit LEDCU3 performs determination processing of the light control information BI based on the light control information BI inputted from outside. In FIG. 14, the LED control unit LEDCU3 first determines whether or not there is a change in brightness represented by the light control information BI (step S201).

In step S201, when there is no change in the brightness, the LED control unit LEDCU3 ends the processing. On the other hand, when there is a change in the brightness, the LED control unit LEDCU3 (for example, the selection unit SELU3) determines whether or not the brightness is lower than predetermined reference brightness (in this example, 10%) (in other words, whether or not the brightness represents the low brightness light control) (step S202). When the brightness does not represent the low brightness light control, the LED control unit LEDCU3 (for example, the selection unit SELU3) selects the second drive signal GD2*a* from the current feedback control unit IFBU1 (step S203).

On the other hand, when the brightness represents the low brightness light control in step S202, the LED control unit LEDCU3 sets the current pulse setting value PIS (that is, fixed PWM cycle and PWM duty) stored in the storage unit MEM to the fixed pulse control unit PCU (step S204). Thereafter, the LED control unit LEDCU3 starts operation of the fixed pulse control unit PCU (step S205). Further, along with step S205, the LED control unit LEDCU3 (for example, the selection unit SELU3) selects the second drive signal GD2*b* from the fixed pulse control unit PCU (step S206). Further, along with step S205, the target voltage setting unit TGV sets a target voltage according to the light control information BI.

Details of Voltage Feedback Control Unit (Modified Example [3])

Figure 15:
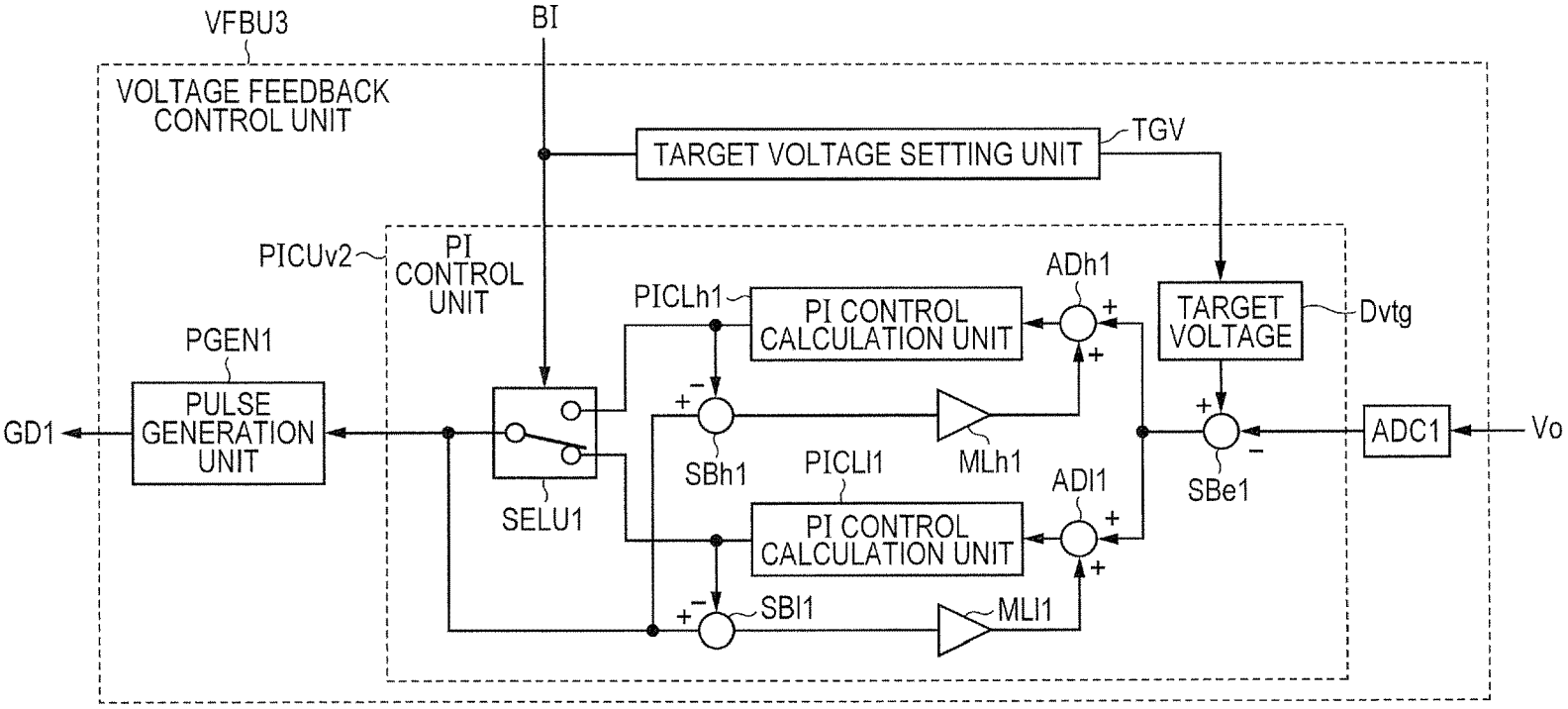
FIG. 15 is a block diagram showing a detailed configuration example of a main part of a voltage feedback control unit in FIG. 13.

FIG. 15 is a block diagram showing a detailed configuration example of a main part of the voltage feedback control unit in FIG. 13. The voltage feedback control unit VFBU3 shown in FIG. 15 has a configuration in which the target voltage setting unit TGV is added to the voltage feedback control unit VFBU2 shown in FIG. 12. The target voltage setting unit TGV sets a predetermined fixed value as a target voltage digital value Dvtg when the brightness based on the light control information BI is higher than predetermined reference brightness, and sets a value according to the brightness based on the light control information BI (for example, a value proportional to the brightness) as the target voltage digital value Dvtg when the brightness based on the light control information BI is lower than the predetermined reference brightness.

In the LED drive system of the fourth embodiment, as described above, sufficient adjustability to a target voltage is required during the low brightness light control in order to variably control the output voltage Vo during the low brightness light control. Therefore, as also described in the third embodiment, it is useful to use the PI control unit PICUv2 including the two PI control calculation units PICLh1 and PICLl1 as shown in FIGS. 15 and 12.

As described above, by using the LED drive system, the LED drive device, and the LED drive method of the fourth embodiment, it is possible to obtain the same effect as that of the first embodiment. Further, in some cases, it is possible to improve light control resolution during the low brightness light control.

While the invention made by the inventors has been specifically described based on the embodiments, the present invention is not limited to the above embodiments and can be variously modified without departing from the scope of the invention. For example, the above embodiments are described in detail in order to describe the present invention in an easily understandable manner, and the embodiments are not necessarily limited to those that include all the components described above. Further, some components of a certain embodiment can be replaced by components of another embodiment, and components of a certain embodiment can be added to components of another embodiment. Further, regarding some components of each embodiment, it is possible to perform addition/deletion/exchange of other components.

Appendix

An LED drive device according to an embodiment of the present invention drives an LED provided outside by using an AC voltage inputted from outside. The LED drive device includes a rectifier, a voltage conversion unit, a constant current drive unit, and a control unit. The rectifier rectifies an AC voltage. The voltage conversion unit includes a coil and a first switch, and converts a voltage outputted from the rectifier into a first voltage which is a DC voltage by controlling on/off of the first switch by a first drive signal. The constant current drive unit is provided with the first voltage, includes a coil and a second switch, generates a drive current having a current value according to light control information inputted from outside by controlling on/off of the second switch by a second drive signal that is a PWM signal, and drives the LED by the drive current. The control unit includes a target current setting unit, a current feedback control unit, a fixed pulse control unit, a target voltage setting unit, and a voltage feedback control unit, and generates a first drive signal and a second drive signal. The target current setting unit sets a target current representing a target of the drive current according to the light control information. The current feedback control unit determines a PWM duty of the second drive signal based on an error between the drive current and the target current in a first case in which brightness based on the light control information is higher than predetermined reference brightness. The fixed pulse control unit generates the second drive signal having a predetermined fixed PWM cycle and PWM duty in a second case in which the brightness based on the light control information is lower than the reference brightness. The target voltage setting unit sets a target voltage representing a target of the first voltage according to the light control information. The voltage feedback control unit generates the first drive signal based on an error between the first voltage and the target voltage.

What is claimed is:

1. An LED drive method that drives an LED by a drive current, the LED drive method using:

a voltage conversion unit which includes a coil and a first switch, and converts an external voltage into a first voltage which is a DC voltage by controlling the first switch to be on in an on-pulse period of a first drive signal;

a constant current drive unit which is provided with the first voltage and which generates a drive current based on a second drive signal; and a control unit which includes a target voltage setting unit, and generates the first drive signal and the second drive signal, and the target voltage setting unit sets a target voltage representing a target of the drive current according to a light control information, wherein the control unit performs:

a first step of comparing a brightness based on the light control information and a predetermined reference brightness;

a second step of generating the first drive signal based on an error between the first voltage and the target voltage;

a third step of generating the second drive signal based on the light control information in a first case in which the brightness based on the light control information is higher than the predetermined reference brightness; and a fourth step of generating the second drive signal having a predetermined fixed on-pulse period in a second case in which the brightness based on the light control information is lower than the predetermined reference brightness, and wherein, in the fourth step, the control unit performs a fifth step of updating the target voltage based on the light control information in the second case.

2. The LED drive method according to claim 1, wherein in the fourth step, the control unit generates the second drive signal having a predetermined fixed cycle in addition to the on-pulse period.

3. The LED drive method according to claim 1, wherein, in the second step, the control unit performs:

a sixth step of converting the first voltage into a first digital value proportional to the first voltage; and a seventh step of calculating an error between the first digital value and a target voltage digital value representing the target of the first voltage and determining the on-pulse period of the first drive signal by a digital calculation using the error as an input.

4. The LED drive method according to claim 1, wherein the constant current drive unit includes a coil and a second switch, and generates the drive current by controlling on/off of the second switch by a second drive signal that is a PWM signal, and wherein the control unit further performs:

an eighth step of converting the drive current into a second digital value proportional to the drive current;

a ninth step of setting a target current digital value representing a target of the drive current according to the light control information; and a tenth step of calculating an error between the second digital value and the target current digital value and calculating a PWM duty of the second drive signal by a digital calculation using the error as an input.

5. An LED drive circuit that drives an LED by a drive current, the LED drive method using:

a voltage conversion unit which includes a coil and a first switch, and converts an external voltage into a first voltage which is a DC voltage by controlling the first switch to be on in an on-pulse period of a first drive signal;

a constant current drive unit which is provided with the first voltage and which generates a drive current based on a second drive signal; and a control unit which includes a target voltage setting unit, and generates the first drive signal and the second drive signal, and the target voltage setting unit sets a target voltage representing a target of the drive current according to a light control information, wherein the control unit performs:

a first step of comparing a brightness based on the light control information and a predetermined reference brightness;

a second step of generating the first drive signal based on an error between the first voltage and the target voltage;

a third step of generating the second drive signal based on the light control information in a first case in which the brightness based on the light control information is higher than the predetermined reference brightness; and a fourth step of generating the second drive signal having a predetermined fixed on-pulse period in a second case in which the brightness based on the light control information is lower than the predetermined reference brightness, and wherein, in the fourth step, the control unit performs a fifth step of updating the target voltage based on the light control information in the second case.

6. The LED drive circuit according to claim 5, wherein in the fourth step, the control unit generates the second drive signal having a predetermined fixed cycle in addition to the on-pulse period.

7. The LED drive circuit according to claim 5, wherein, in the second step, the control unit performs:

a sixth step of converting the first voltage into a first digital value proportional to the first voltage; and a seventh step of calculating an error between the first digital value and a target voltage digital value representing the target of the first voltage and determining the on-pulse period of the first drive signal by a digital calculation using the error as an input.

8. The LED drive circuit according to claim 5, wherein the constant current drive unit includes a coil and a second switch, and generates the drive current by controlling on/off of the second switch by a second drive signal that is a PWM signal, and wherein the control unit further performs:

an eighth step of converting the drive current into a second digital value proportional to the drive current;

a ninth step of setting a target current digital value representing a target of the drive current according to the light control information; and a tenth step of calculating an error between the second digital value and the target current digital value and calculating a PWM duty of the second drive signal by a digital calculation using the error as an input.

9. An LED drive circuit, comprising:

a voltage conversion unit comprising a coil and a first switch, the voltage conversion unit converting an external voltage into a first voltage which is a DC voltage by controlling the first switch to be on in an on-pulse period of a first drive signal;

a constant current drive unit which receives the first voltage and which generates a drive current based on a second drive signal; and a control unit comprising a target voltage setting unit and which generates the first drive signal and the second drive signal, the target voltage setting unit setting a target voltage representing a target of the drive current according to a light control information, wherein the control unit:

compares a brightness based on the light control information and a predetermined reference brightness;

generates the first drive signal based on an error between the first voltage and the target voltage;

generates the second drive signal based on the light control information in a first case in which the brightness based on the light control information is higher than the predetermined reference brightness; and generates the second drive signal having a predetermined fixed on-pulse period in a second case in which the brightness based on the light control information is lower than the predetermined reference brightness, by updating the target voltage based on the light control information in the second case.

10. The LED drive circuit according to claim 9, wherein in the generating of the second drive signal in the second case, the control unit generates the second drive signal having a predetermined fixed cycle in addition to the on-pulse period.

11. The LED drive circuit according to claim 9, wherein, in the generating of the first drive signal, the control unit:

converts the first voltage into a first digital value proportional to the first voltage; and calculates an error between the first digital value and a target voltage digital value representing the target of the first voltage and determines the on-pulse period of the first drive signal by a digital calculation using the error as an input.

12. The LED drive circuit according to claim 9, wherein the constant current drive unit includes a coil and a second switch, and generates the drive current by controlling on/off of the second switch by a second drive signal that is a PWM signal, and wherein the control unit further:

converts the drive current into a second digital value proportional to the drive current;

sets a target current digital value representing a target of the drive current according to the light control information; and calculates an error between the second digital value and the target current digital value and calculates a PWM duty of the second drive signal by a digital calculation using the error as an input.

* * * * *